US006243073B1

(12) United States Patent
Kawamura et al.

(10) Patent No.: US 6,243,073 B1
(45) Date of Patent: Jun. 5, 2001

(54) VIDEO DISPLAY MONITOR

(75) Inventors: Hideaki Kawamura, Kyoto; Mitsuhiro Kasahara, Hirakata; Kazuo Ohira, Ibaraki; Takehisa Hirano, Kyoto; Katsuhiro Nakai, Sanda, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 08/986,504

(22) Filed: Dec. 8, 1997

(30) Foreign Application Priority Data

Dec. 6, 1996 (JP) ..... 8-326397
Apr. 3, 1997 (JP) ..... 9-084954

(51) Int. Cl.[7] ..... G09G 5/10

(52) U.S. Cl. ..... 345/148; 345/60; 345/63; 345/213

(58) Field of Search ..... 345/148, 147, 345/213, 67–68, 60, 74–75, 63, 89, 212, 132; 348/797, 447

(56) References Cited

U.S. PATENT DOCUMENTS 5,541,618 * 7/1996 Shinoda ..... 345/60
5,724,053 * 3/1998 Nagakubo ..... 345/60
5,818,419 * 10/1998 Tajima et al. ..... 345/147
6,037,917 * 3/2000 Kawakami ..... 345/63

FOREIGN PATENT DOCUMENTS 0 344 623 12/1989 (EP) .
0 653 740 5/1995 (EP) .
4-195087 7/1992 (JP) .
6-12988 1/1994 (JP) .
08076716 3/1996 (JP) .
8-202311 8/1996 (JP) .
8-286636 11/1996 (JP) .
9-127911 5/1997 (JP) .

* cited by examiner

*Primary Examiner*—Richard Hjerpe
*Assistant Examiner*—Frances Nguyen
(74) *Attorney, Agent, or Firm*—Ratner & Prestia

(57) ABSTRACT

A video display monitor, such as a plasma monitor, which uses a subfield method which overlaps weighted multiple binary video images in a time base for display. The stable driving of a plasma display panel may be assured and display in the 256 grey-level may be maintained although vertical synchronizing frequency of the input video signal changes. A vertical synchronizing measurement unit measures the vertical synchronizing frequency of the video signal, and a subfield number adjustment unit adjusts the number of subfields in accordance with a measured vertical synchronizing frequency. The stable driving of the plasma display panel and display in grey levels may be assured by selecting a ROM table with an output bit width equivalent to the number of subfields to be output from multiple ROM tables used for converting the number of bits in the input signal.

16 Claims, 20 Drawing Sheets

| Table conversion ROM | Output bit width | Subfield No. | | | | | | | | | | | | | |
|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 |
| — | 8bit | 128 | 64 | 32 | 16 | 8 | 4 | 2 | 1 | – | – | – | – | – | – |
| ROM1 | 9bit | 64 | 64 | 64 | 32 | 16 | 8 | 4 | 2 | 1 | – | – | – | – | – |
| ROM2 | 10bit | 48 | 48 | 48 | 48 | 32 | 16 | 8 | 4 | 2 | 1 | – | – | – | – |
| ROM3 | 11bit | 48 | 48 | 32 | 32 | 32 | 32 | 16 | 8 | 4 | 2 | 1 | – | – | – |
| ROM4 | 12bit | 32 | 32 | 32 | 32 | 32 | 32 | 32 | 16 | 8 | 4 | 2 | 1 | – | – |
| ROM5 | 13bit | 32 | 32 | 32 | 32 | 32 | 32 | 16 | 16 | 16 | 8 | 4 | 2 | 1 | – |
| ROM6 | 14bit | 32 | 32 | 32 | 32 | 32 | 16 | 16 | 16 | 16 | 16 | 8 | 4 | 2 | 1 |

Fig. 10

Fig. 11

| Subfield | 1 | 2 | 3 | 4 | 5 | 6 | 7 | 8 | 9 | 10 | 11 | 12 |
|---|---|---|---|---|---|---|---|---|---|---|---|---|
| Weighting | 32 | 32 | 32 | 32 | 32 | 32 | 32 | 16 | 8 | 4 | 2 | 1 |
| Gradation | | | | | | | | | | | | |
| 0 | | | | | | | | | | | | |
| 1 | | | | | | | | | | | | ○ |
| 2 | | | | | | | | | | | ○ | |
| 3 | | | | | | | | | | | ○ | ○ |
| 4 | | | | | | | | | | ○ | | |
| 5 | | | | | | | | | | ○ | | ○ |
| 6 | | | | | | | | | | ○ | ○ | |
| 7 | | | | | | | | | | ○ | ○ | ○ |
| 8 - 15 | | | | | | | | | ○ | ( Identical to 0 - 7 ) | | |
| 16 - 31 | | | | | | | | ○ | ( Identical to 0 - 15 ) | | | |
| 32 - 63 | | | | | | | ○ | ( Identical to 0 - 31 ) | | | | |
| 64 - 95 | | | | | | ○ | ○ | ( Identical to 0 - 31 ) | | | | |
| 96 - 127 | | | | | ○ | ○ | ○ | ( Identical to 0 - 31 ) | | | | |
| 128 - 159 | | | | ○ | ○ | ○ | ○ | ( Identical to 0 - 31 ) | | | | |
| 160 - 191 | | | ○ | ○ | ○ | ○ | ○ | ( Identical to 0 - 31 ) | | | | |
| 192 - 223 | | ○ | ○ | ○ | ○ | ○ | ○ | ( Identical to 0 - 31 ) | | | | |
| 224 - 255 | ○ | ○ | ○ | ○ | ○ | ○ | ○ | ( Identical to 0 - 31 ) | | | | |

Fig. 12

| Subfield | 1 | 2 | 3 | 4 | 5 | 6 | 7 | 8 | 9 | 10 | 11 |
|---|---|---|---|---|---|---|---|---|---|---|---|
| Weighting | 48 | 48 | 32 | 32 | 32 | 32 | 16 | 8 | 4 | 2 | 1 |
| Gradation | | | | | | | | | | | |
| 0 | | | | | | | | | | | |
| 1 | | | | | | | | | | | ○ |
| 2 | | | | | | | | | | ○ | |
| 3 | | | | | | | | | | ○ | ○ |
| 4 | | | | | | | | | ○ | | |
| 5 | | | | | | | | | ○ | | ○ |
| 6 | | | | | | | | | ○ | ○ | |
| 7 | | | | | | | | | ○ | ○ | ○ |
| 8 - 15 | | | | | | | | ○ | ( Identical to 0 - 7 ) | | |
| 16 - 31 | | | | | | | ○ | ( Identical to 0 - 15 ) | | | |
| 32 - 63 | | | | | | ○ | ( Identical to 0 - 31 ) | | | | |
| 64 - 95 | | | | | ○ | ○ | ( Identical to 0 - 31 ) | | | | |
| 96 - 127 | | | | ○ | ○ | ○ | ( Identical to 0 - 31 ) | | | | |
| 128 - 159 | | | ○ | ○ | ○ | ○ | ( Identical to 0 - 31 ) | | | | |
| 160 - 175 | | ○ | ○ | ○ | ○ | | ○ | ( Identical to 0 - 15 ) | | | |
| 176 - 207 | | ○ | ○ | ○ | ○ | ○ | ( Identical to 0 - 31 ) | | | | |
| 208 - 223 | ○ | ○ | ○ | ○ | ○ | | ○ | ( Identical to 0 - 15 ) | | | |
| 224 - 255 | ○ | ○ | ○ | ○ | ○ | ○ | ( Identical to 0 - 31 ) | | | | |

Fig. 13

| Subfield | 1 | 2 | 3 | 4 | 5 | 6 | 7 | 8 | 9 | 10 | 11 | 12 | 13 |
|---|---|---|---|---|---|---|---|---|---|---|---|---|---|
| Weighting | 32 | 32 | 32 | 32 | 32 | 32 | 16 | 16 | 16 | 8 | 4 | 2 | 1 |
| Gradation | | | | | | | | | | | | | |
| 0 | | | | | | | | | | | | | |
| 1 | | | | | | | | | | | | | ○ |
| 2 | | | | | | | | | | | | ○ | |
| 3 | | | | | | | | | | | | ○ | ○ |
| 4 | | | | | | | | | | | ○ | | |
| 5 | | | | | | | | | | | ○ | | ○ |
| 6 | | | | | | | | | | | ○ | ○ | |
| 7 | | | | | | | | | | | ○ | ○ | ○ |
| 8 - 15 | | | | | | | | | | ○ | ( Identical to 0 - 7 ) | | |
| 16 - 31 | | | | | | | | | ○ | ( Identical to 0 - 15 ) | | | |
| 32 - 47 | | | | | | | | ○ | ○ | ( Identical to 0 - 15 ) | | | |
| 48 - 63 | | | | | | | ○ | ○ | ○ | ( Identical to 0 - 15 ) | | | |
| 64 - 95 | | | | | | ○ | ○ | ○ | ( Identical to 0 - 31 ) | | | | |
| 96 - 127 | | | | | ○ | ○ | ○ | ○ | ( Identical to 0 - 31 ) | | | | |
| 128 - 159 | | | | ○ | ○ | ○ | ○ | ○ | ( Identical to 0 - 31 ) | | | | |
| 160 - 191 | | | ○ | ○ | ○ | ○ | ○ | ○ | ( Identical to 0 - 31 ) | | | | |
| 192 - 223 | | ○ | ○ | ○ | ○ | ○ | ○ | ○ | ( Identical to 0 - 31 ) | | | | |
| 224 - 255 | ○ | ○ | ○ | ○ | ○ | ○ | ○ | ○ | ( Identical to 0 - 31 ) | | | | |

VIDEO DISPLAY MONITOR

FIELD OF THE INVENTION

The present invention relates to video display monitors including plasma displays which employ a subfield method for overlapping weighted multiple binary video screens in a time base for display.

BACKGROUND OF THE INVENTION

The use of plasma display monitors has recently expanded into the area of color display monitors which offer drastically slimmer units. Plasma display monitors employ a subfield method for displaying half tone, as disclosed in Japanese Laid-open Patent No. H4-195087. In DC plasma display monitors, for example, their driving method may require display data write and sustaining periods as disclosed in Japanese Laid-open Patent No. H6-12988. Configuration of a video display monitor of the prior art is explained next with reference to FIGS. 15, 16, and 17.

FIG. 15 shows the configuration of a video display monitor of the prior art employing a single scanning system driving method. The conventional video display monitor comprises a synchronizing signal separator 1 for separating the video signal, a timing pulse generator 2 for producing a timing pulse in accordance with the synchronizing signal separated by the synchronizing signal separator 1, an A/D converter 3 for converting the video signal to digital signal, a subfield processor 4, a frame memory 5 required for the subfield processor 4, a DC plasma display panel 9, an anode driving circuit 6 for the DC plasma display panel 9, a cathode driving circuit 7, and an auxiliary anode driving circuit 8.

In the video display monitor as configured above, the A/D converter 3 converts the video signal to a digital signal, and outputs the digital signal to the subfield processor 4. At the same time, the synchronizing signal separator 1 separates the synchronizing signal from the video signal. The timing generator 2 produces a timing pulse required in the subfield processor 4 and A/D converter 3 in accordance with the synchronizing signal output from the synchronizing signal separator 1. The subfield processor 4 implements the following operations with the frame memory 5.

The subfield processor 4 divides one field of the video signal into multiple subfields in order to display grey levels of the video signal, and outputs a required signal to the cathode driving circuit 7 and auxiliary anode driving circuit 8. The subfield processor 4 also converts the input video digital signal for obtaining grey levels of the video signal using the subfield method, and supplies the converted signal to the anode driving circuit 6. A group of anode electrodes is connected in the vertical direction of the screen to each of the multiple anode electrode terminals. Similarly, a group of auxiliary anode electrodes is connected in the vertical direction of the screen to each of multiple auxiliary anode electrode terminals. A group of cathode electrodes is connected in the horizontal direction of the screen to each of the multiple cathode electrode terminals. A line created by connecting these cathode electrodes horizontally is called a scanning line hereafter.

FIGS. 16A to 16E show waveforms of driving circuits of a plasma display panel 9. These figures explain the relation between a signal (pulse) applied to the anode electrode terminal and signals applied to the cathode terminal and auxiliary anode electrode terminal, using one anode electrode terminal.

First, the cathode driving circuit 7 outputs an "active low" write pulse SC from a first cathode electrode terminal K1 (hereafter referred to as the "scanning line K1.") to a last cathode electrode terminal Km as shown in FIGS. 16C to 16E. Referring to FIG. 16B, the anode driving circuit 6 outputs a synchronized "active high" write pulse, and video data DK1, DK2, DK3, etc. which corresponds to each scanning line of the anode electrode terminal. Similarly, the auxiliary anode driving circuit 8 outputs an "active high" auxiliary anode pulse synchronized to the write pulse, for priming discharge, to the auxiliary anode electrode terminal as shown in FIG. 16A. The auxiliary anode pulse is output to assure discharge in the anode electrode.

As explained above, the write pulse is successively applied from the scanning line K1 to Km. At the same time, video data corresponding to each cathode of each scanning line is applied to each successive anode electrode terminal, and the auxiliary anode pulse is applied to the auxiliary anode electrode terminal.

Referring to FIG. 16E, the cathode driving circuit 7 then outputs a sustaining pulse during a sustaining period (SUS) after the output of the write pulse. The sustaining pulse is applied to assure discharge in the anode electrode terminal for securely illuminating the plasma display panel. The length of the sustaining period corresponds to the weight of the digital video signal.

FIG. 17 shows an example of the subfield method which repeats write and sustaining operations for displaying the video image in an 8-bit 256 grey-level. In FIG. 17, time is plotted along the abscissa, and the scanning lines K1 to Km are plotted along the ordinate. In this case, a driving period Tk0 in one-field period Tf0 is divided into eight subfields SF1 to SF8. In this example, the length of the sustaining period in a first subfield SF1 corresponds to the MSB (Most Significant Bit), that is 128t (where t is a predetermined unit of period). In other words, the same length of the sustaining period is given to each scanning line from K1 to Km in the same subfield.

After completing the scanning of the first subfield, a second subfield SF2 is scanned. In the second subfield, the anode driving circuit 6 outputs video data to the anode electrode terminal. This video data corresponds to the second significant bit (2nd SB) in the digital video signal of each scanning line. The cathode driving circuit 7 outputs the sustaining pulse to each scanning line during the sustaining period corresponding to the second significant bit (2nd SB) after the write pulse. The length of the sustaining period for the second subfield, that is the second significant bit, is 64t for example. Likewise, the anode driving circuit 6 outputs video data, corresponding to each bit in the digital video signal of each scanning line, to the anode electrode terminal in each subfield. The length of the sustaining period for the third subfield SF3, that is the third significant bit, is 32t for example. For each subfield, the length of the sustaining pulse is set to correspond to the bit weight. In an eighth subfield SF8, the length of the sustaining period is 1t for example.

Accordingly, the conventional video display monitor is capable of displaying a video image in 256 grey-levels by controlling the illumination sustaining period for each pixel to correspond to each digital signal value.

In the above explanation, the conventional video display monitor employs a single scanning system as the driving method. On the other hand, there are video display monitors which employ the double scanning system as the driving method. In the driving method employing the double scanning system, electrodes of the plasma display panel are divided into two groups: an upper group and a lower group.

These groups are controlled independently and simultaneously for displaying video images by dividing one field into nine subfields or more. A video display monitor employing the double scanning system is explained next with reference to FIGS. 18, 19, and 20.

FIG. 18 shows the configuration of a video display monitor of the prior art employing the double scanning system. The conventional video display monitor comprises a synchronizing signal separator 1 for separating the video signal, a timing pulse generator 2 for producing a timing pulse in accordance with the synchronizing signal separated by the synchronizing signal separator 1, an A/D converter for converting the video signal to digital signal, a subfield processor 4, a frame memory 5 required for the subfield processor 4, a DC plasma display panel 39 for the double scanning system, an upper anode driving circuit and upper auxiliary anode driving circuit 36 for controlling an upper half of the DC plasma display panel 39, an upper and lower cathode driving circuit 37, and a lower anode driving circuit and lower auxiliary anode driving circuit 38 for controlling a lower half of the DC plasma display panel 39.

In the video display monitor as configured as above, the subfield processor 4 divides one field of the video signal into multiple subfields in order to display video signals in grey levels. Subfield processor 4 then outputs required signals to the upper and lower cathode driving circuit 37, upper anode driving circuit and upper auxiliary anode driving circuit 36, and lower anode driving circuit and lower auxiliary anode driving circuit 38. The operations of the anode electrode, cathode electrode, and auxiliary anode electrode are identical to the single scanning system, and their explanation is not repeated.

In the video display monitor as configured above, the subfield processor 4 implements the following operation with the frame memory 5. The subfield processor 4 converts the input digital video signal for displaying the video signal into grey levels by dividing it into subfields. Subfield processor 4 then outputs the converted signal to the upper anode driving circuit and upper auxiliary anode driving circuit 36, the upper and lower cathode driving circuit 37, and the lower anode driving circuit and lower auxiliary anode driving circuit 38.

FIGS. 19A to 19H show waveforms of the DC plasma display panel driving circuit employing the double scanning system.

The upper and lower cathode driving circuit 37 outputs a write pulse to the cathode electrode terminals on scanning lines K1 to Kn in the upper half of the plasma display panel. At the same time, it outputs the write pulse to cathode electrode terminals on scanning lines K(n+1) to Km. Here, a value n is 2n=m, where m refers to the total number of cathode electrode terminals.

The upper anode driving circuit and upper auxiliary anode driving circuit 36 output video data synchronized to the write pulse, to upper anode electrode terminals, where the video data corresponds to each scanning line. The upper anode driving circuit and upper auxiliary driving circuit 36 also output an auxiliary anode pulse for priming the discharge to the upper auxiliary anode electrode terminals. At the same time, the lower anode driving circuit and lower auxiliary anode driving circuit 38 output video data, corresponding to each scanning line, to the lower anode electrode terminals, and also outputs an auxiliary anode pulse for priming the discharge to lower auxiliary anode electrode terminals. Likewise, the write pulse is successively applied from scanning lines K1 and K(n+1) to Kn and Km. In addition, video data DK1, DK2, DK3, etc. and DK(n+1), DK(n+2), DK(n+3), etc., corresponding to each cathode on each scanning line, are simultaneously applied to anode electrode terminals at the same time, and the auxiliary anode pulse is applied to auxiliary anode electrode terminals.

The upper and lower cathode driving circuit 37 also outputs a sustaining pulse for a sustaining period SUS to each cathode electrode terminal after the write pulse. The sustaining pulse is applied to assure discharge in the anode electrode terminals for securely illuminating the plasma display panel. The length of this sustaing period corresponds to the weight of the digital video signal.

FIG. 20 shows an example of the subfield method for displaying in the 256 grey-level by repeating the above write and sustaining operations. The double scanning system only requires scanning cathode electrode terminals in half of the plasma display panel. Therefore, it is possible to divide one field into nine or more subfields. Accordingly, upper significant bits can be divided into multiple subfields. It is conventionally known that degradation of picture quality, called the moving picture pseudo contour peculiar to the plasma display panel, can be reduced by dividing the upper significant bits into multiple subfields.

In this example, the upper and lower cathode driving circuit 37 outputs the sustaining pulse for the sustaining period corresponding to a quarter of the MSB (128t) in the video signal, that is 32t for example, to the scanning lines K1 to Kn in the upper half screen and the scanning lines K(n+1) to Km in the lower half screen for a first subfield SF1. Then, for a second subfield SF2, the upper and lower cathode driving circuit 37 also output the sustaining pulse of the sustaining period of 32t of the MSB in the video signal. In this example, one field of the video signal is divided into twelve subfields SF1 to SF12. The duration of the sustaining pulse of 4 subfield corresponds to a quarter of the MSB weighted with the value 128 in the digital video signal, followed by half of a second MSB weighted with the value 64 in the next 2 subfields, and a bit weight of the six lower bits in the remaining 6 subfields. Accordingly, the sustaining pulse is output for a period corresponding to a quarter of the MSB for the first subfield to the LSB for the twelfth subfield consecutively. These outputs illuminate each pixel for each video bit, enabling the display of a 256 grey-level signal.

Current video display monitors are required to correspond to a wide range of vertical synchronizing frequencies other than 60 Hz, which is the general vertical synchronizing frequency, in response to different types of input signals. In the conventional configuration as explained above, however, the driving of the first subfield in a next field may start while driving the eighth subfield in the previous field, if the frequency of the vertical synchronizing signal in the video signal is high and a one-field period becomes shorter than the driving period for eight subfields, resulting in unstable driving of the plasma display panel.

If a pulse width of the write pulse and sustaining pulse are shortened or their frequencies are increased to avoid the above disadvantage, a period sufficient for driving the plasma display panel cannot be secured. This also results in unstable on and off operation of the plasma display panel.

If the vertical synchronizing frequency is low, on the other hand, and a one-field period becomes longer, a period for driving the plasma display panel clusters in the first half of one field, and a driving recess period after driving the eighth subfield becomes longer, resulting in noticeable flickering.

Furthermore, in the double scanning system, in addition to the above disadvantages of the single scanning system, the driving of the first subfield in a next field may start while driving the twelfth subfield in the previous field, if one-field period becomes shorter than the driving period for twelve subfields, resulting in unstable driving of the plasma display panel.

If a pulse width of the write pulse and sustaining pulse are shortened or their frequencies are increased to avoid the above disadvantages, a period sufficient for driving the plasma display panel cannot be secured. This also results in unstable on and off operation of the plasma display panel.

If the vertical synchronizing frequency is short, on the other hand, and one-field period becomes longer, a period for driving the plasma display panel clusters at the first half of one field, and a driving recess period after driving the twelfth subfield becomes longer, resulting in noticeable flickering.

SUMMARY OF THE INVENTION

A video display monitor allows grey level display by dividing each field of the video signal into multiple subfields which are respectively weighted with a time width or a number of pulses, and thereby overlapping video images of these subfields in a time base for display. A vertical synchronizing frequency measurement unit measures the vertical synchronizing frequency of the video signal. A subfield number adjustment unit adjusts the number of subfields in accordance with the easured vertical synchronizing frequency.

BRIEF DESCRIPTION OF THE DRAWINGS

A

FIG. 10 is an example of weighting each subfield for each output bit width.

FIG. 11 is an example of subfield allocation for each grey level in accordance with the fourth exemplary embodiment of the present invention.

FIG. 12 is an example of subfield allocation for each grey level in accordance with the fourth exemplary embodiment of the present invention.

FIG. 13 is an example of subfield allocation for each grey level in accordance with the fourth exemplary embodiment of the present invention.

DESCRIPTION OF THE PREFERRED EMBODIMENTS

First Exemplary Embodiment

Figure 2:
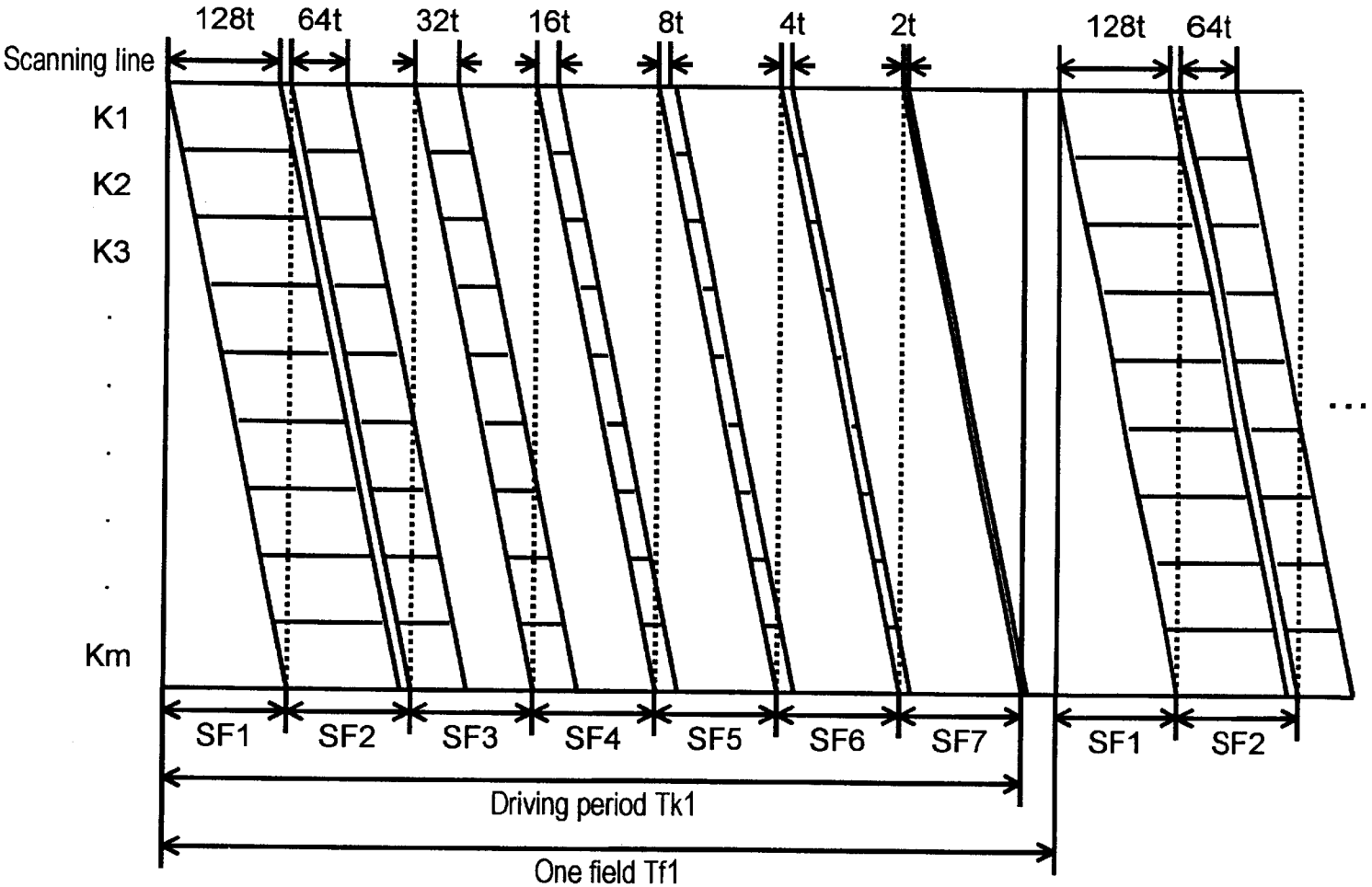
FIG. 2 is a configuration of a subfield in accordance with the first exemplary embodiment of the present invention.
Figure 3:
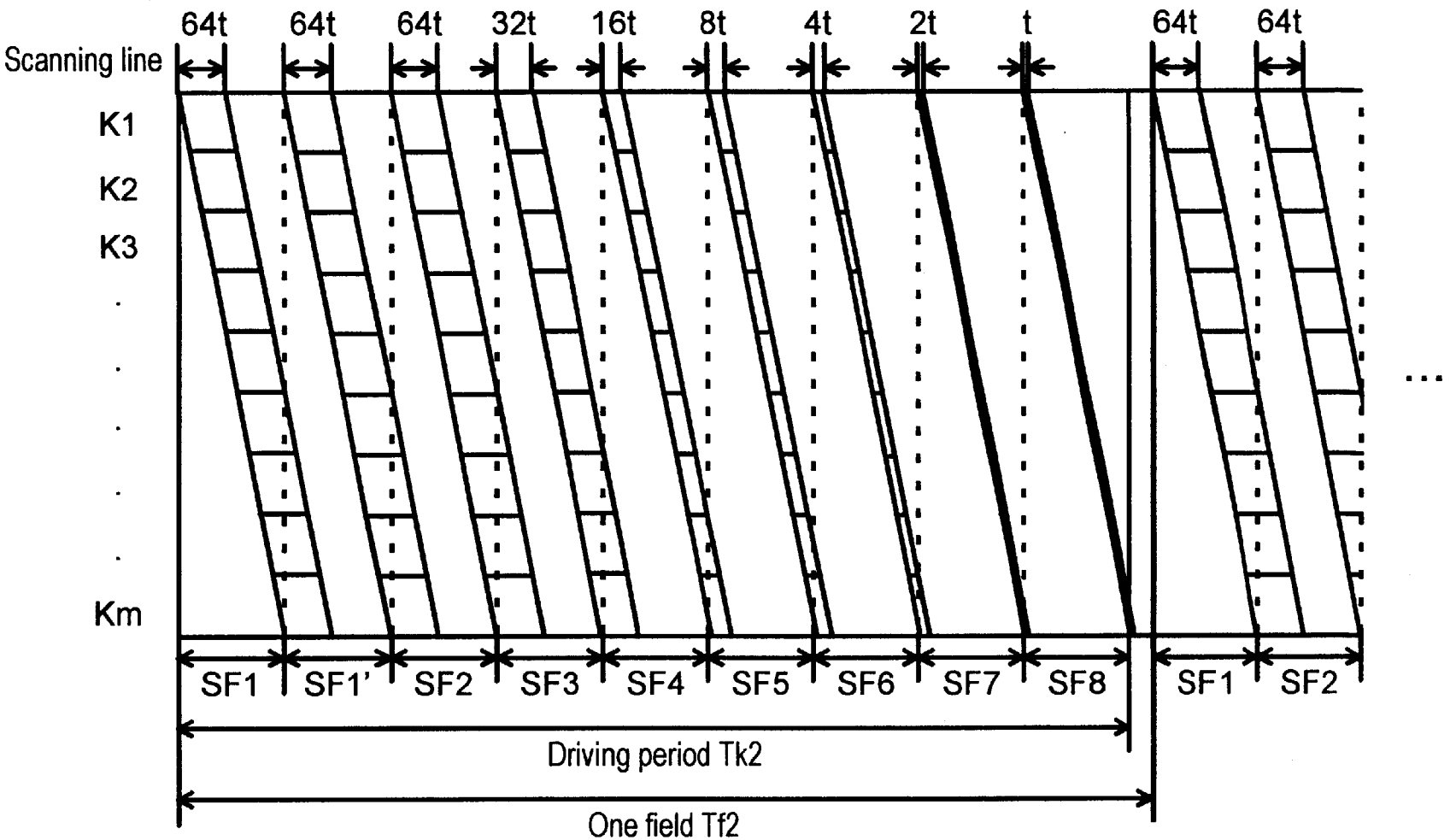
FIG. 3 is a configuration of a subfield in accordance with the first exemplary embodiment of the present invention.

A first exemplary embodiment of the present invention is explained in detail with reference to FIGS. 1 to 3.

Figure 1:
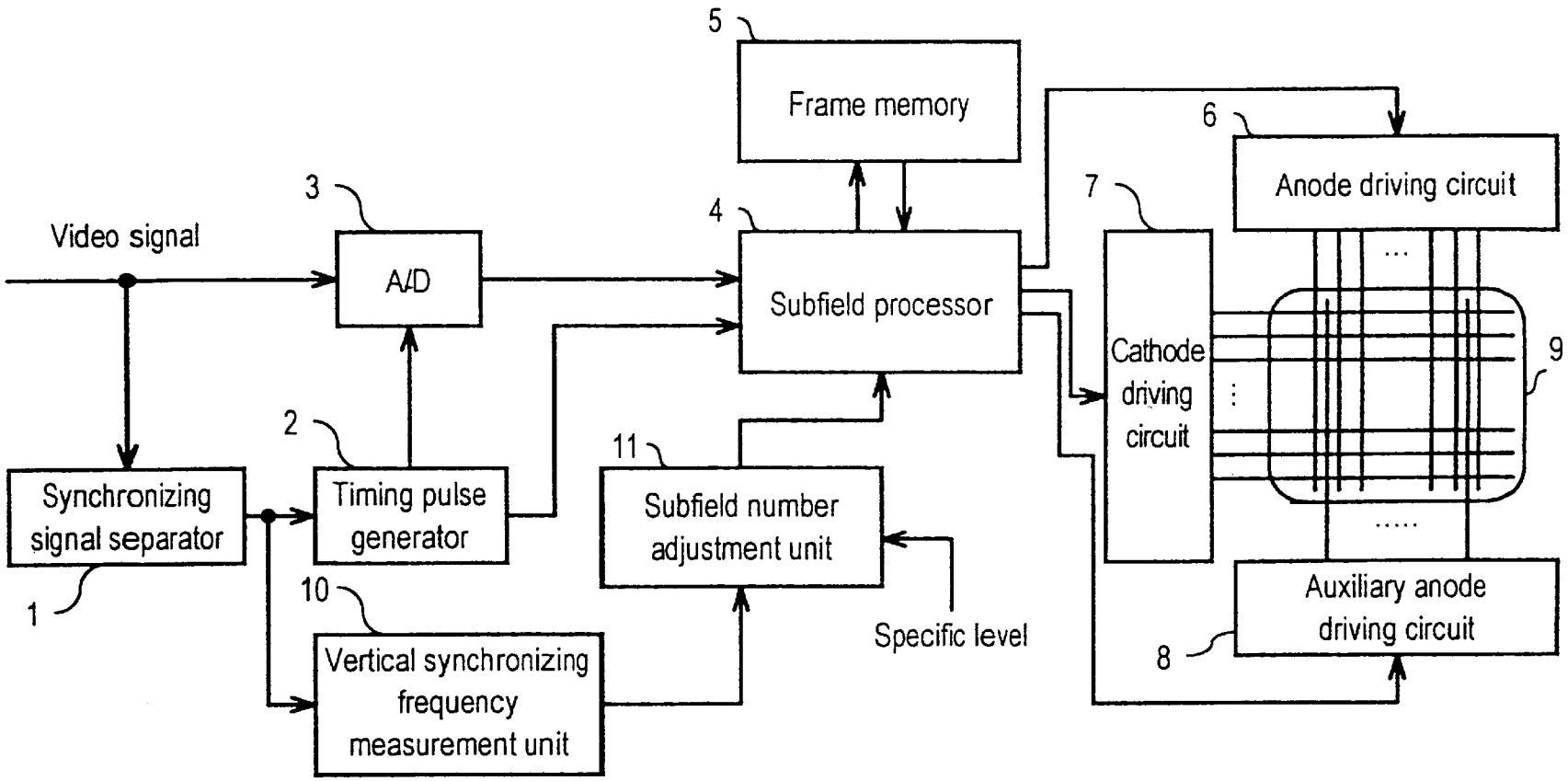
FIG. 1 is a configuration of a video display monitor in accordance with first exemplary embodiment of the present invention.
Figure 15:
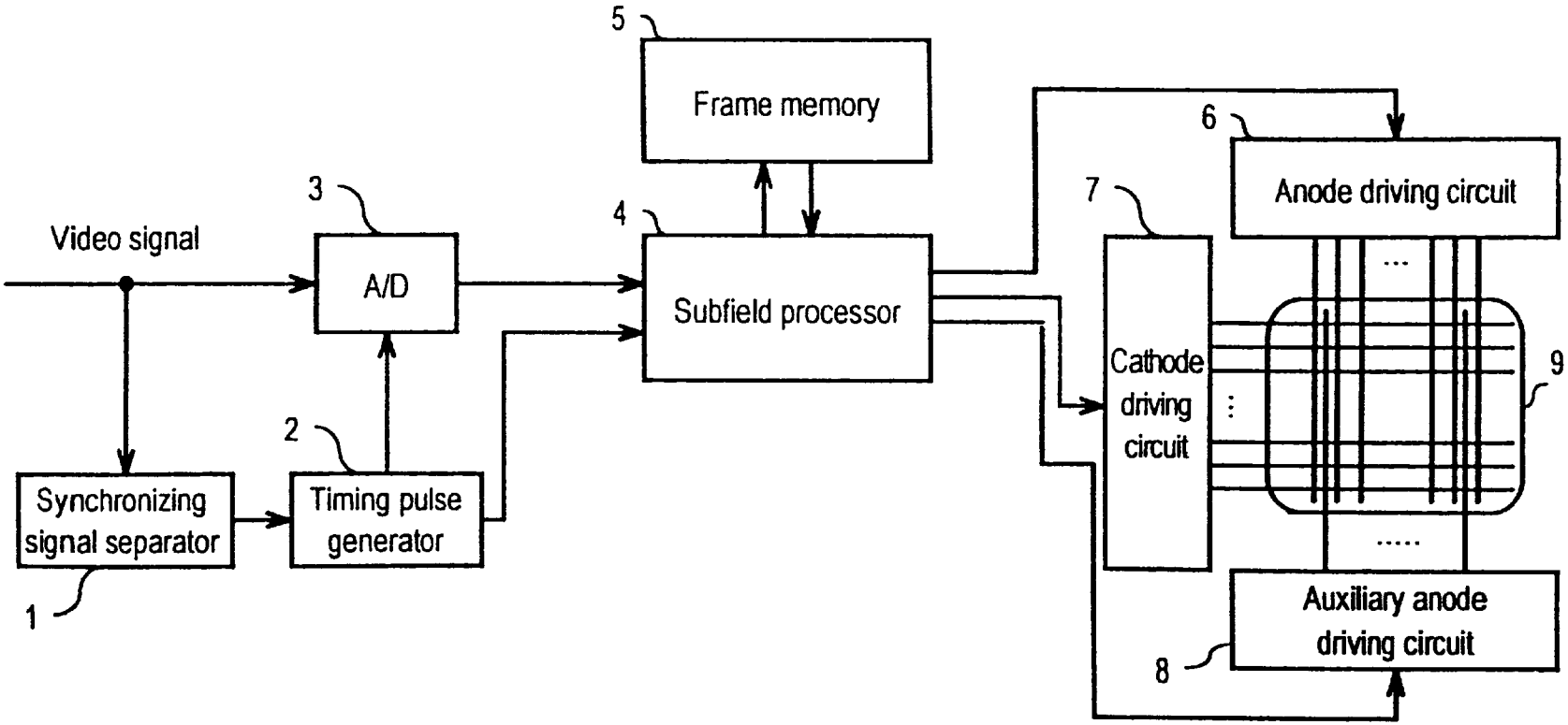
Fig. 15 PRIOR ART
FIG. 15 is a configuration of a video display monitor of the prior art.
Figure 16:
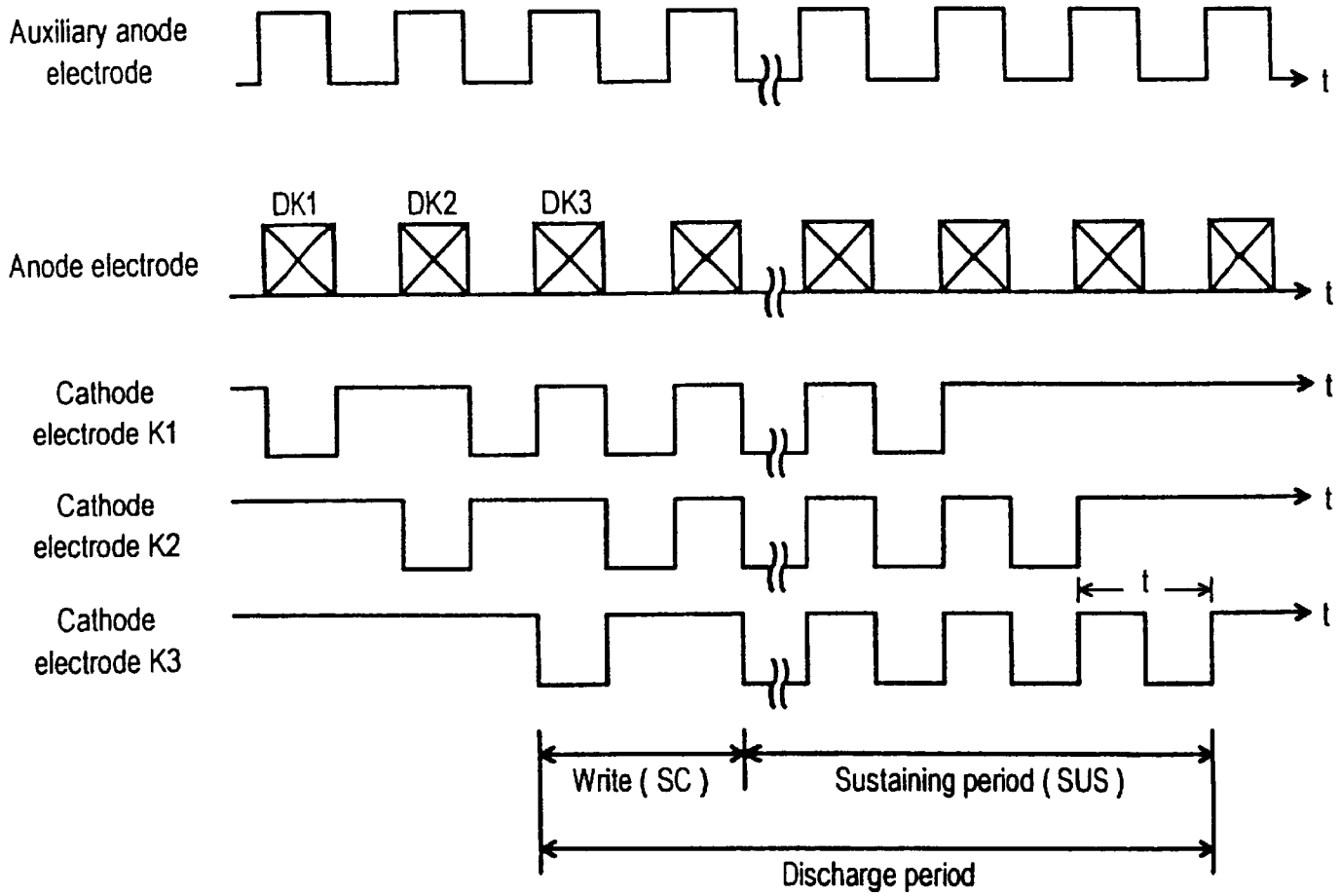
Fig. 16 PRIOR ART
FIGS. 16A to 16E are driving waveforms of a DC plasma display panel in the prior art.
Figure 17:
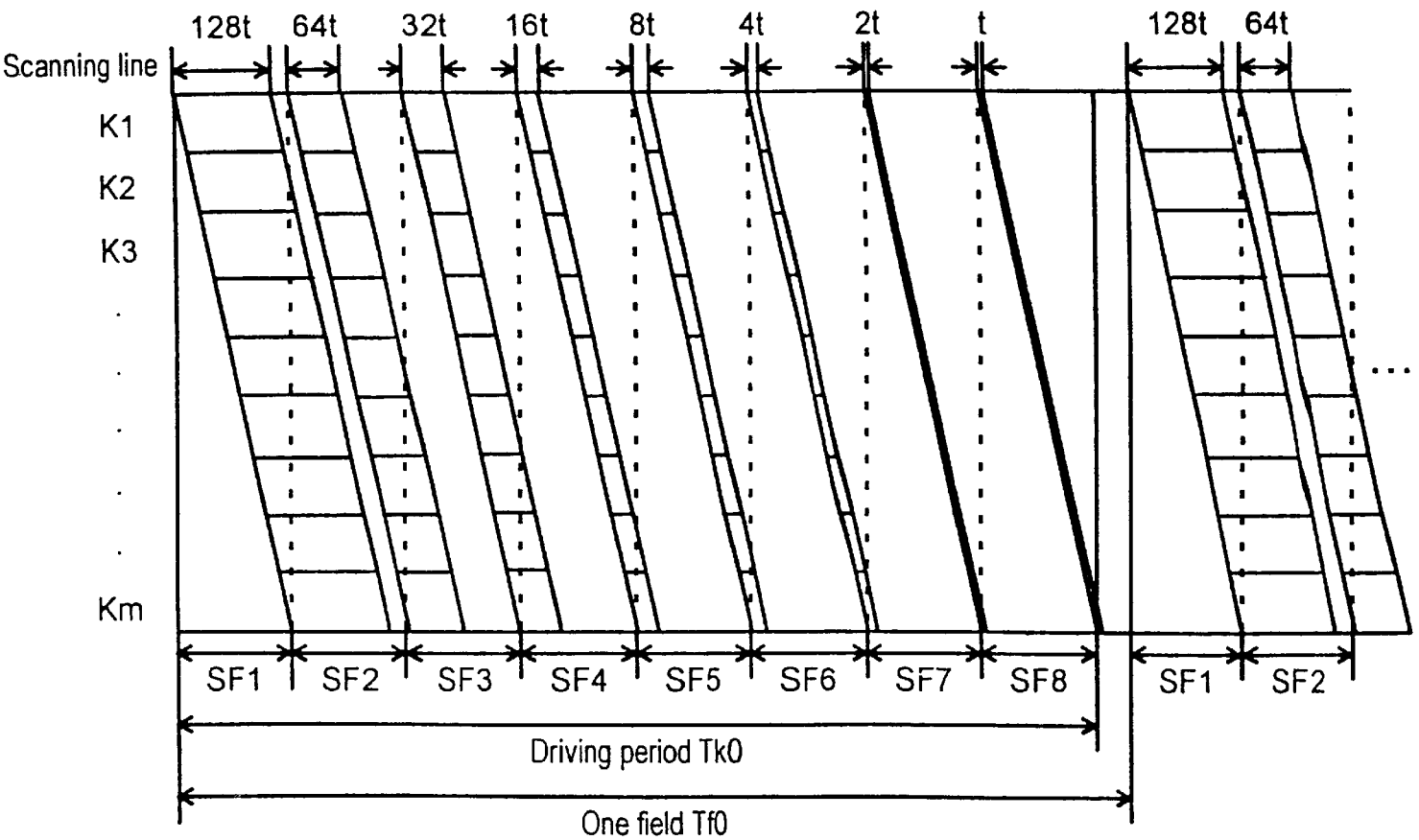
Fig. 17 PRIOR ART
FIG. 17 shows a configuration of a subfield in the prior art.

FIG. 1 shows a configuration of a multi-scan adaptive video display monitor in a first exemplary embodiment of the present invention. The video display monitor of the present invention comprises a synchronizing separator 1, timing pulse generator 2, A/D converter 3, subfield processor 4, frame memory 5, anode driving circuit 6, cathode driving circuit 7, auxiliary anode driving circuit 8, DC plasma display panel 9, vertical synchronizing frequency measurement circuit 10 for measuring the frequency of the vertical synchronizing signal separated in the synchronizing separator 1, and a subfield number adjustment unit 11 for adjusting the number of subfields by controlling the subfield processor 4 based on the vertical synchronizing frequency as measured by the vertical synchronizing frequency measurement circuit 10. Components which have the same purpose and fimction as those in FIG. 15 are given the same reference numbers, and therefore their detailed explanation is not repeated. In FIG. 1, numerals 1 to 9 have the same purpose and configuration as those in FIG. 15 which illustrates a video display monitor of the prior art.

The operation of the multi-scan adaptive video display monitor in the first exemplary embodiment as configured above is explained with reference to FIGS. 2 and 3. In FIGS. 2 and 3, time is plotted along the abscissa and scanning lines K1 to Km are plotted along the ordinate. A driving period Tk1 in a one-field period Tf1 is divided into seven subfields SF1 to SF7. In the exemplary embodiment, the length of the sustaining period in the first subfield SF1 corresponds to the duration of the MSB, and is 128t for example (where t is the predetermined period unit). In other words, the same sustaining period is given to each of the scanning lines K1 to Km in the same subfield.

The synchronizing separator 1 separates the vertical synchronizing signal from the input video signal. The vertical synchronizing frequency measurement circuit 10 measures the vertical synchronizing frequency of the vertical synchronizing signal. Referring to FIG. 2, the subfield number adjustment unit 11 instructs the subfield processor 4 to drive from the first subfield SF1 to the seventh subfield SF7. The eighth subfield is not driven when the vertical synchronizing frequency exceeds a specified first level at which it may become impossible to drive up to the eighth subfield within a one-field period.

When the vertical synchronizing frequency decreases below a specified second level at which it may be possible to drive up to a ninth subfield within a one-field period. In this case, the subfield number adjustment unit 11 instructs the subfield processor 4 to divide the first subfield into 64t each (SF1 and SF1' in FIG. 3) to drive the plasma display panel with a total of nine subfields.

In the first exemplary embodiment as configured above, the subfield number adjustment unit 11 decreases the number of subfields when the vertical synchronizing frequency is higher than the first specified level, and the subfield number adjustment unit 11 increases the number of subfields when the vertical synchronizing frequency is lower than the second specified level. This avoids driving the first subfield of the next field while driving the subfield for a video image in a certain field where the video signal is not yet completed due to a high vertical synchronizing frequency. Moreover, it can prevent completion of one field of the input video signal and the starting of the first subfield in the next field while driving a certain subfield. Accordingly, driving the plasma display panel may be stabilized. Moreover, the first exemplary embodiment enables the prevention of flicker by preventing clustering of driving of the plasma display panel in the first half of one field. This leaves some time after completing the driving of the eighth subfield, caused by a longer one-field period when the vertical synchronizing frequency is low.

In this exemplary embodiment, the subfield number adjustment unit 11 has first and second specified levels for increasing and decreasing the number of subfields in response to the vertical synchronizing frequency. It is possible to reduce the number of subfields or increase the number of subfields based on the relation between a specified level and the vertical synchronizing frequency.

Each specified level is changeable either automatically or by an external instruction.

It is also possible to increase or decrease two or more subfields depending on their frequencies.

The subfield number adjustment means of the video display monitor of the present invention may have at least one of the following functions: i) the number of said subfields is decreased when the vertical synchronizing frequency is higher than a first specified level; ii) the number of said subfields is increased when the vertical synchronizing frequency is lower than a second specified level; and iii) the number of said subfields is decreased when the vertical synchronizing frequency is higher than the first specified level, and the number of subfields is increased when the vertical synchronizing frequency is lower than the second specified level.

The present invention thus offers a multi-scan adaptive video display monitor for assuring the stable driving of a plasma display panel by adjusting the number of subfields in response to the frequency of the vertical synchronizing signal in the input video signal.

Second Exemplary Embodiment

Figure 4:
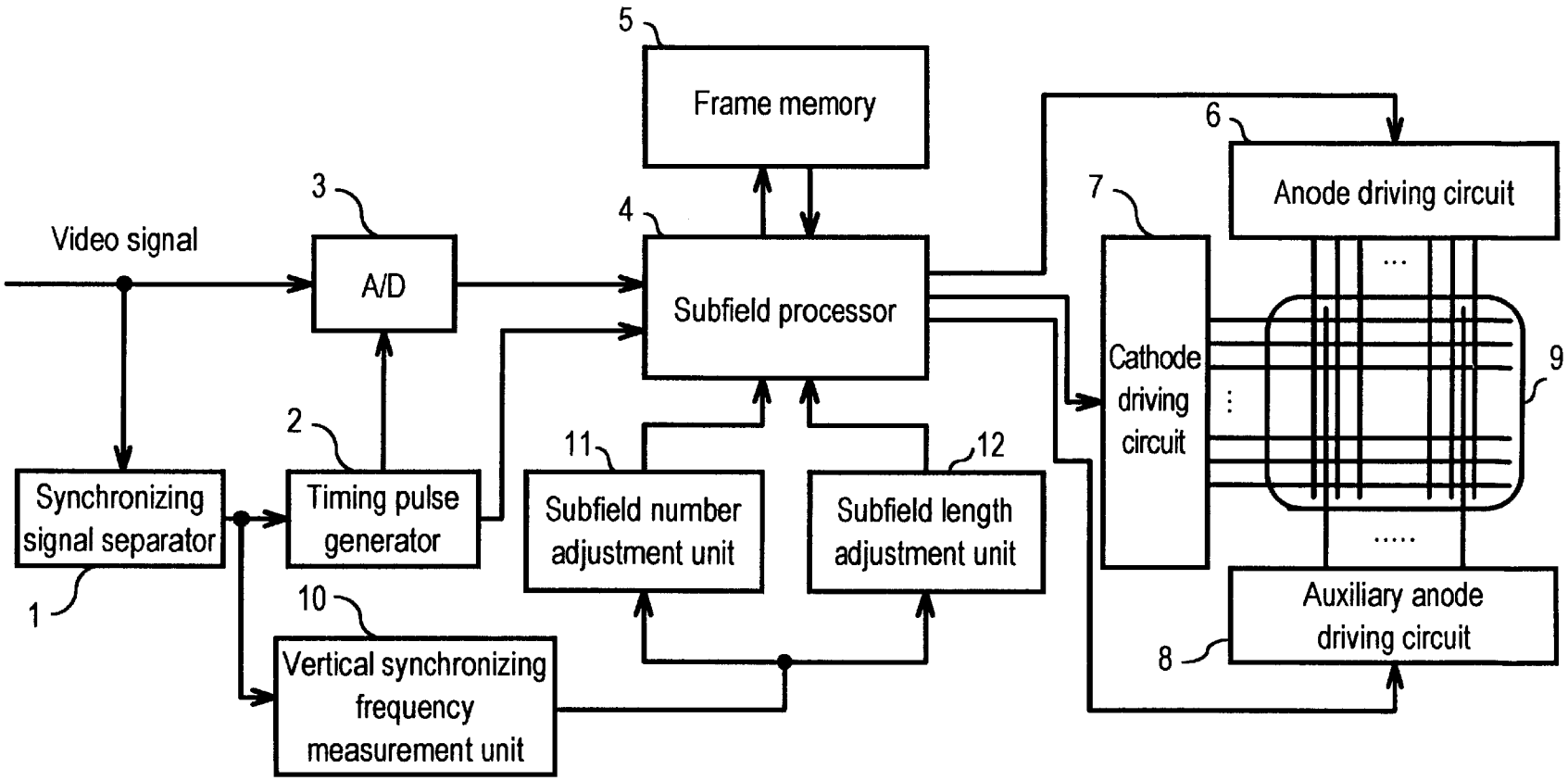
FIG. 4 is a configuration of a video display monitor in accordance with a second exemplary embodiment of the present invention.

FIG. 4 shows a configuration of a multi-scan adaptive video display monitor in a second exemplary embodiment of the present invention. Components which have the same purpose and function as those in FIG. 1 which illustrates the first exemplary embodiment are given the same reference numerals, and therefore their detailed explanation is not repeated. In FIG. 4, numerals 1 to 10 have the same purpose and configuration as those in FIG. 1 illustrated in the first exemplary embodiment.

A subfield number adjustment unit 11 instructs the subfield processor 4 to reduce the number of subfields when the vertical synchronizing frequency measured by the vertical synchronizing frequency measurement circuit 10 is higher than a first specified level. A subfield length adjustment unit 12 instructs the subfield processor 4 to extend the length of the subfield when the vertical synchronizing frequency measured by the vertical synchronizing frequency measurement circuit 10 is lower than a third specified level.

Figure 5:
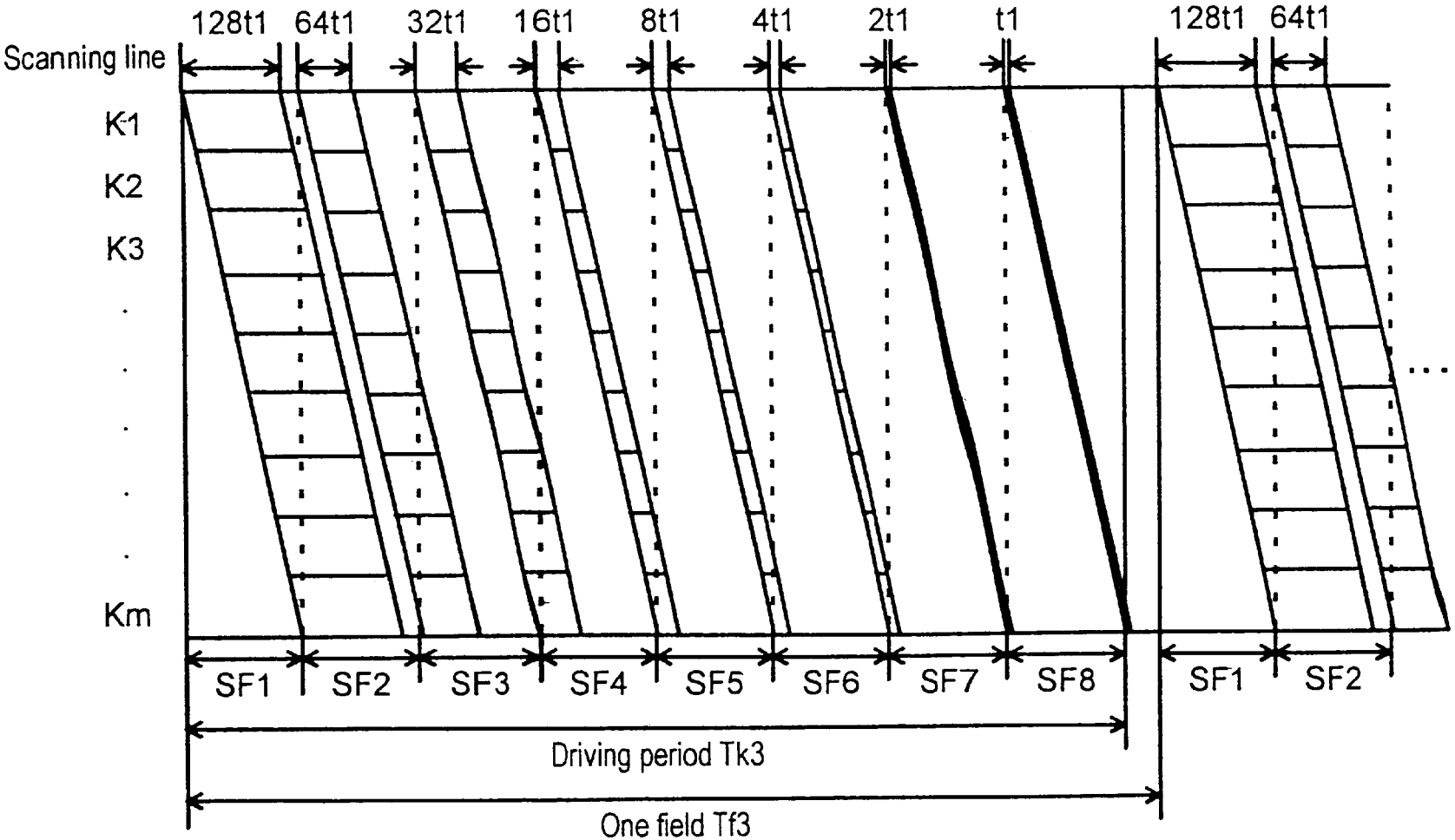
FIG. 5 is a configuration of a subfield in accordance with the second exemplary embodiment of the present invention.

The operation of the multi-scan adaptive video display monitor in the second exemplary embodiment as configured above is explained with reference to FIGS. 4 and 5.

The synchronizing separator 1 separates the vertical synchronizing signal from the input video signal, and the vertical synchronizing frequency measurement circuit 10 measures the vertical synchronizing frequency. The subfield number adjustment unit 11 instructs the subfield processor 4 to drive the plasma display panel, deleting the eighth subfield as shown in FIG. 2, when the vertical synchronizing frequency exceeds the first specified level at which it becomes impossible to drive up to the eighth subfield within a one-field period. The subfield length adjustment unit 12 extends a sustaining period of each subfield by setting a longer time period. For example, referring to FIG. 5, 128t becomes 128t1 (t1>t) for the first subfield when the vertical synchronizing frequency becomes lower than the third specified level.

In the second exemplary embodiment as configured above, the subfield number adjustment unit 11 decreases the number of subfields when the vertical synchronizing frequency is higher than the first specified level, and the subfield length adjustment unit 12 extends the length of the subfield when the vertical synchronizing frequency is lower than the third specified level. Driving the plasma display panel may be stabilized by preventing driving the first subfield in the next field while driving the subfield for a video image in a certain field where the video signal has not complete due to a high vertical synchronizing frequency. The second exemplary embodiment also enables the prevention of flicker by preventing clustering of driving of the plasma display panel in the first half of one field, which leaves some time after completing the driving of the eighth subfield caused by a longer one-field period when the vertical synchronizing frequency is low.

In the exemplary embodiment, it is possible to increase or decrease two or more subfields depending on their frequencies.

The present invention thus offers a multi-scan adaptive video display monitor for assuring the stable driving of a plasma display panel by adjusting the number of subfields in response to the frequency of the vertical synchronizing signal of the input video signal.

Third Exemplary Embodiment

Figure 6:
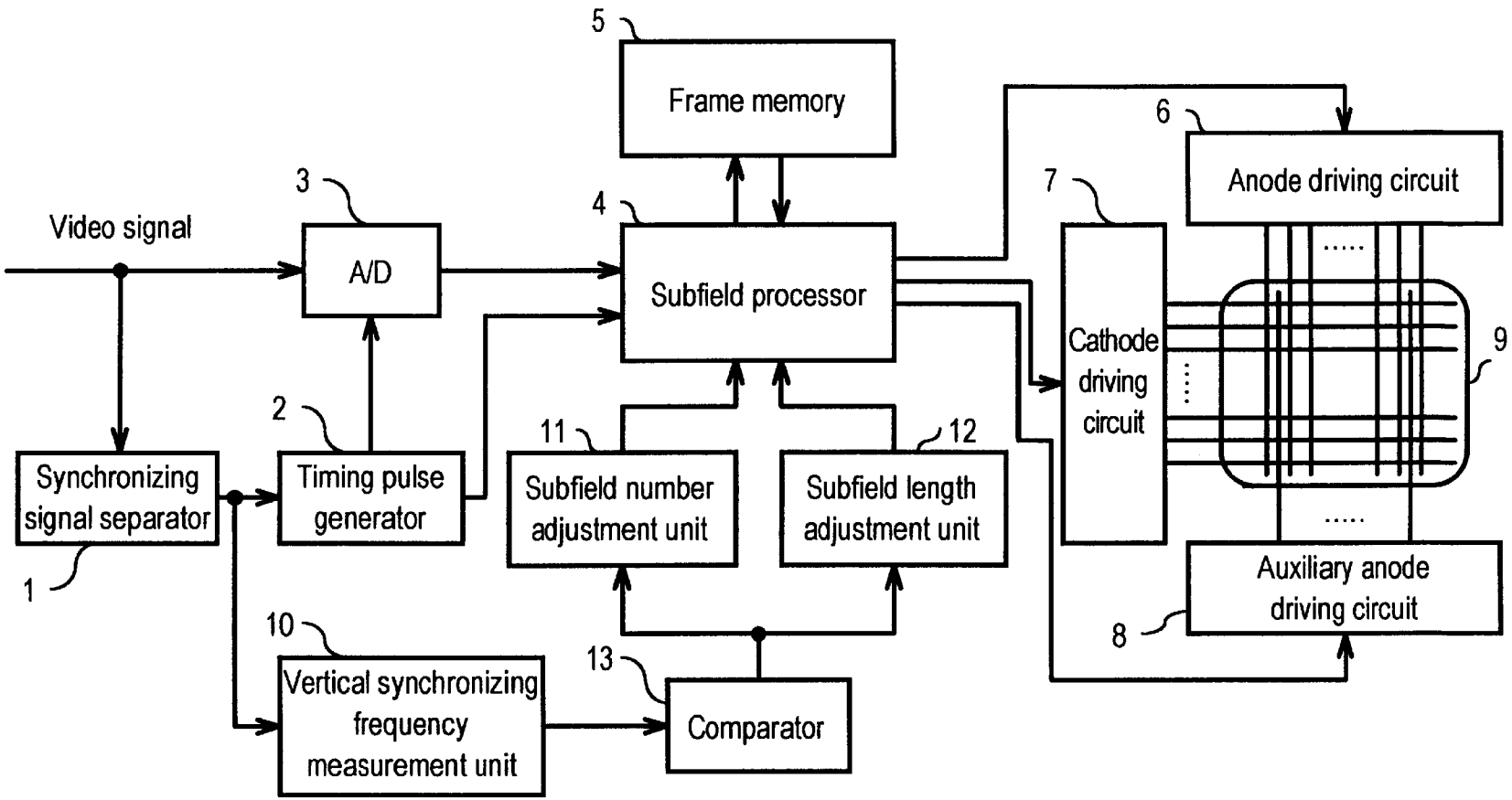
FIG. 6 is a configuration of a video display monitor in accordance with a third exemplary embodiment of the present invention.

FIG. 6 shows a configuration of a multi-scan adaptive video display monitor in a third exemplary embodiment of the present invention. Components which have the same purpose and function as those in FIG. 4, which illustrates the second exemplary embodiment, are given the same reference numerals, and therefore their detailed explanation is not repeated. In FIG. 6, numerals 1 to 12 have the same purpose and configuration as those in FIG. 4 which illustrates the second exemplary embodiment. A comparator 13 compares the vertical synchronizing frequency, the first specified level, and the third specified level based on hysteresis.

In the third exemplary embodiment as configured above, the comparator 13 compares a change in the frequency based on hysteresis, and controls the subfield number adjustment unit 11 and subfield length adjustment unit 12 which may prevent chattering at frequency switchover. The third exemplary embodiment can thus offer a multi-scan adaptive video display monitor which further assures the stable driving of a plasma display panel.

Fourth Exemplary Embodiment

Figure 7:
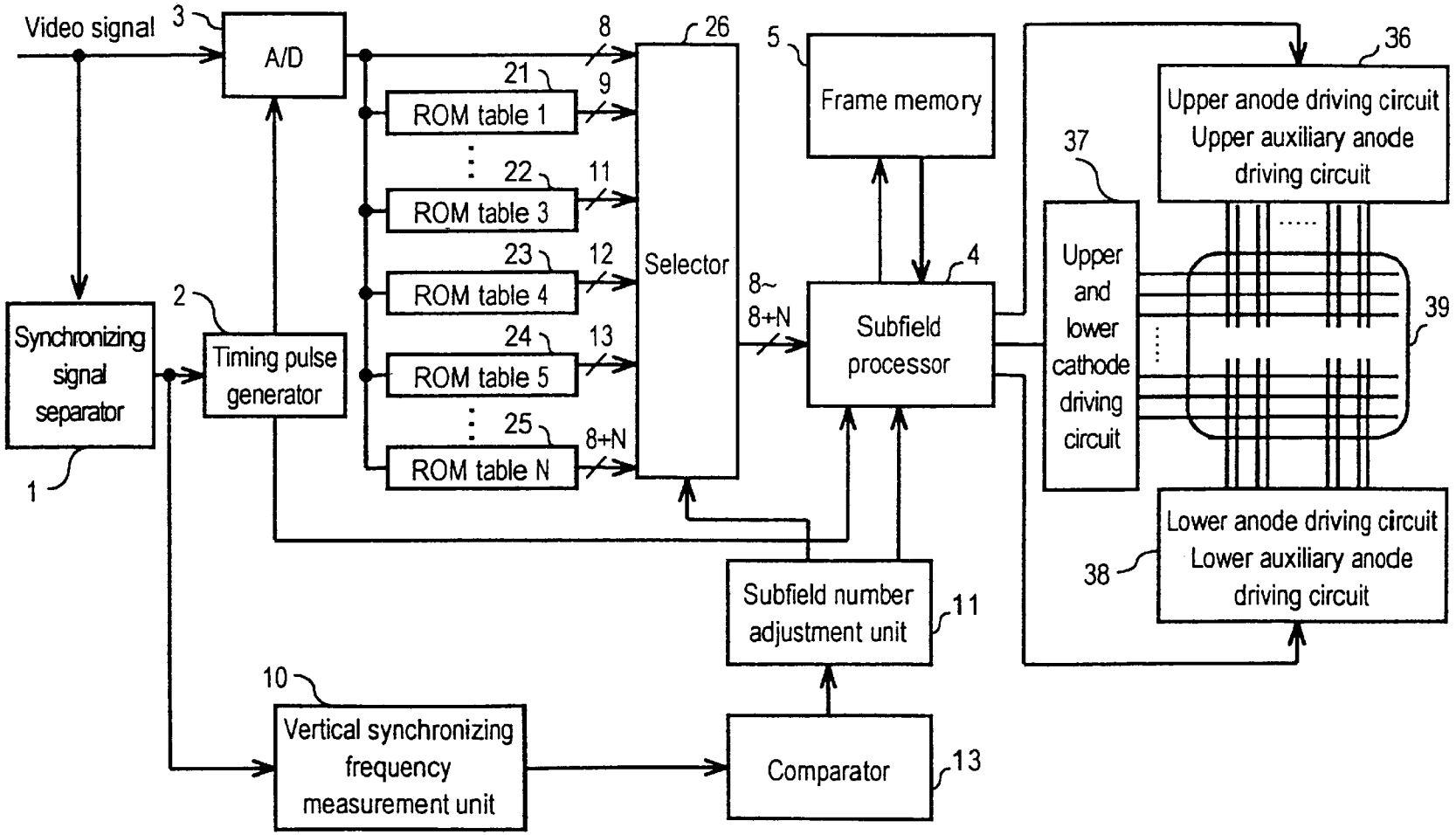
FIG. 7 is a configuration of a video display monitor in accordance with a fourth exemplary embodiment of the present invention.
Figure 18:
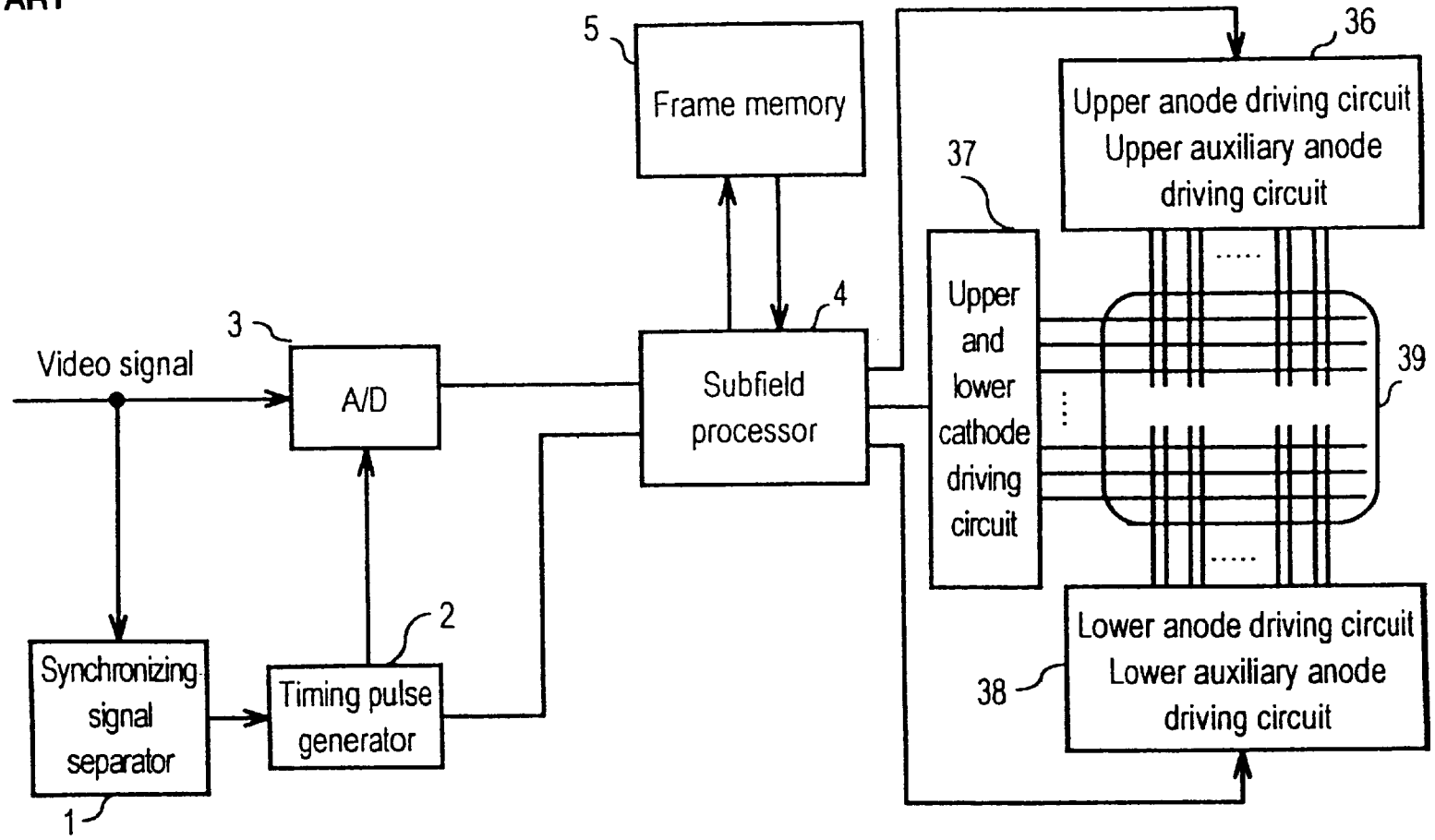
Fig. 18 PRIOR ART
FIG. 18 shows a configuration of a video display monitor employing the double scanning system in the prior art.
Figure 19:
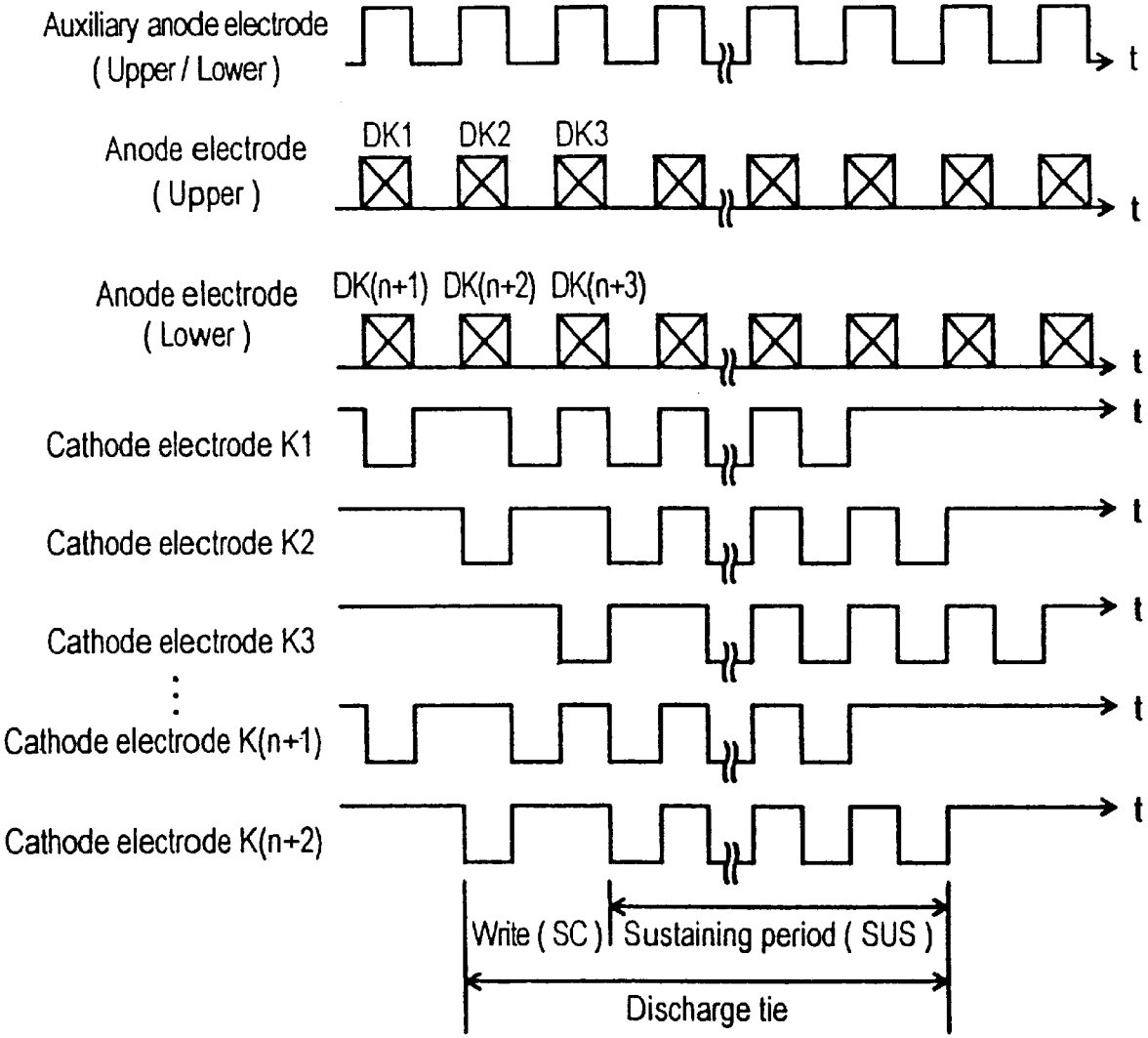
Fig. 19 PRIOR ART
FIGS. 19A to 19H are driving waveforms of a DC plasma display panel in the prior art employing the double scanning system.
Figure 20:
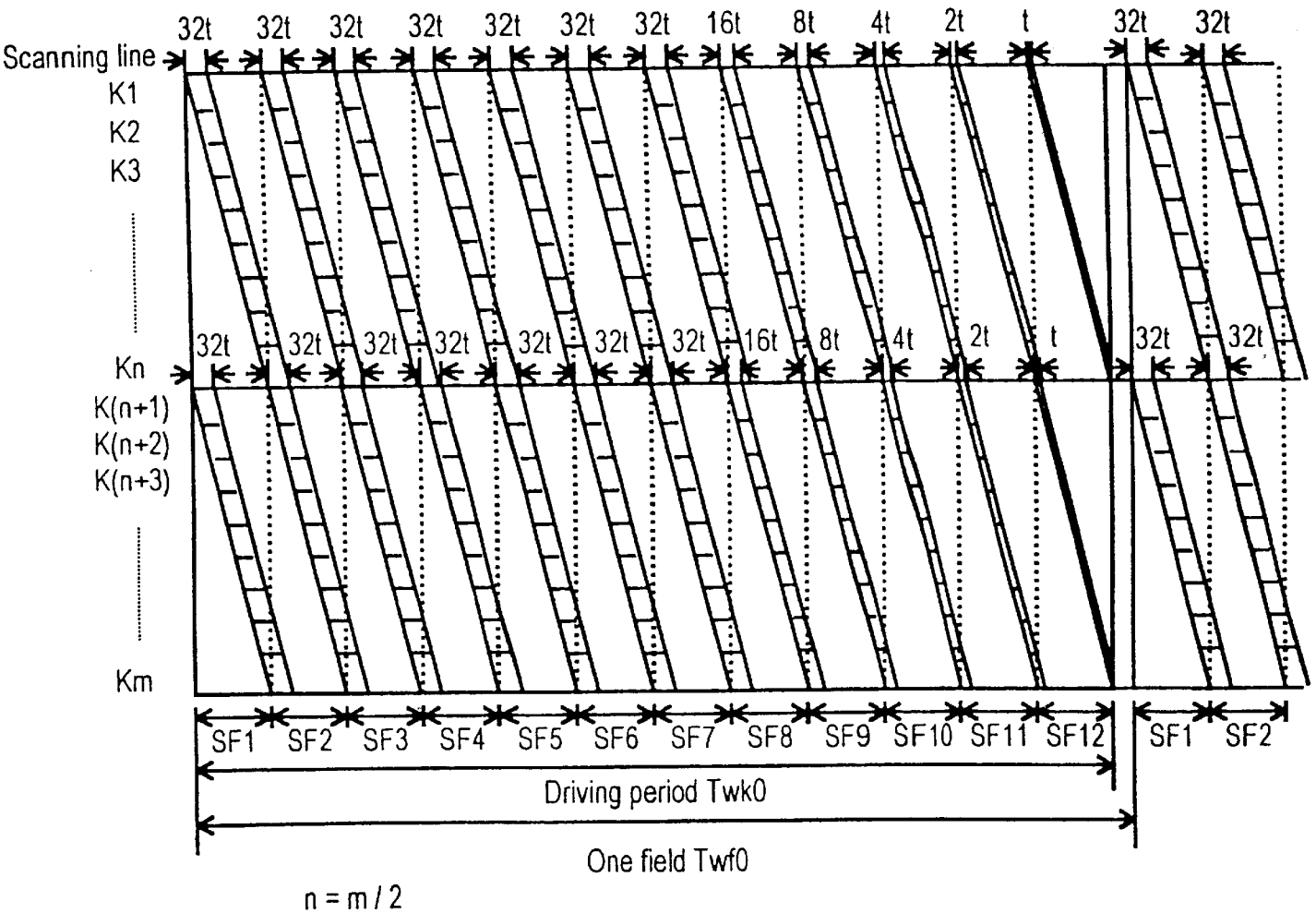
Fig. 20 PRIOR ART
FIG. 20 is a configuration of a subfield in the video display monitor of the prior art employing the double scanning system.

FIG. 7 shows a configuration of a multi-scan adaptive video display monitor in a fourth exemplary embodiment of the present invention. Components which have the same purpose and function as those in FIG. 6 which illustrates the configuration of the third exemplary embodiment, and FIG. 18 which illustrates the conventional double scanning driving method are given the same reference numerals, and therefore their detailed explanation is not repeated. In FIG. 7, reference numerals 1 to 5, 10, 11, and 13 have the same purpose and configuration as those in FIG. 6 which illustrates the third exemplary embodiment, and 36 to 39 as those in FIG. 18 which illustrates the prior art, and their explanation is not repeated.

ROM tables 21 to 25 are for table conversion of the video signal, having an 8-bit input width to a video signal having different output bit widths. For example, the ROM table 21 converts 8-bit input data into 9-bit output data, and the ROM table 25 converts the same 8-bit input data into the 8+N-bit output data.

A selector 26 selects from among the 8-bit output of the A/D converter 3 and the output of the ROM table 21 to the ROM table 25 in accordance with the control signal from the subfield number adjustment unit 11. The numerals 8 to 8+N indicated on arrows which show the flow of signals indicate a bit width of each signal.

Figure 8:
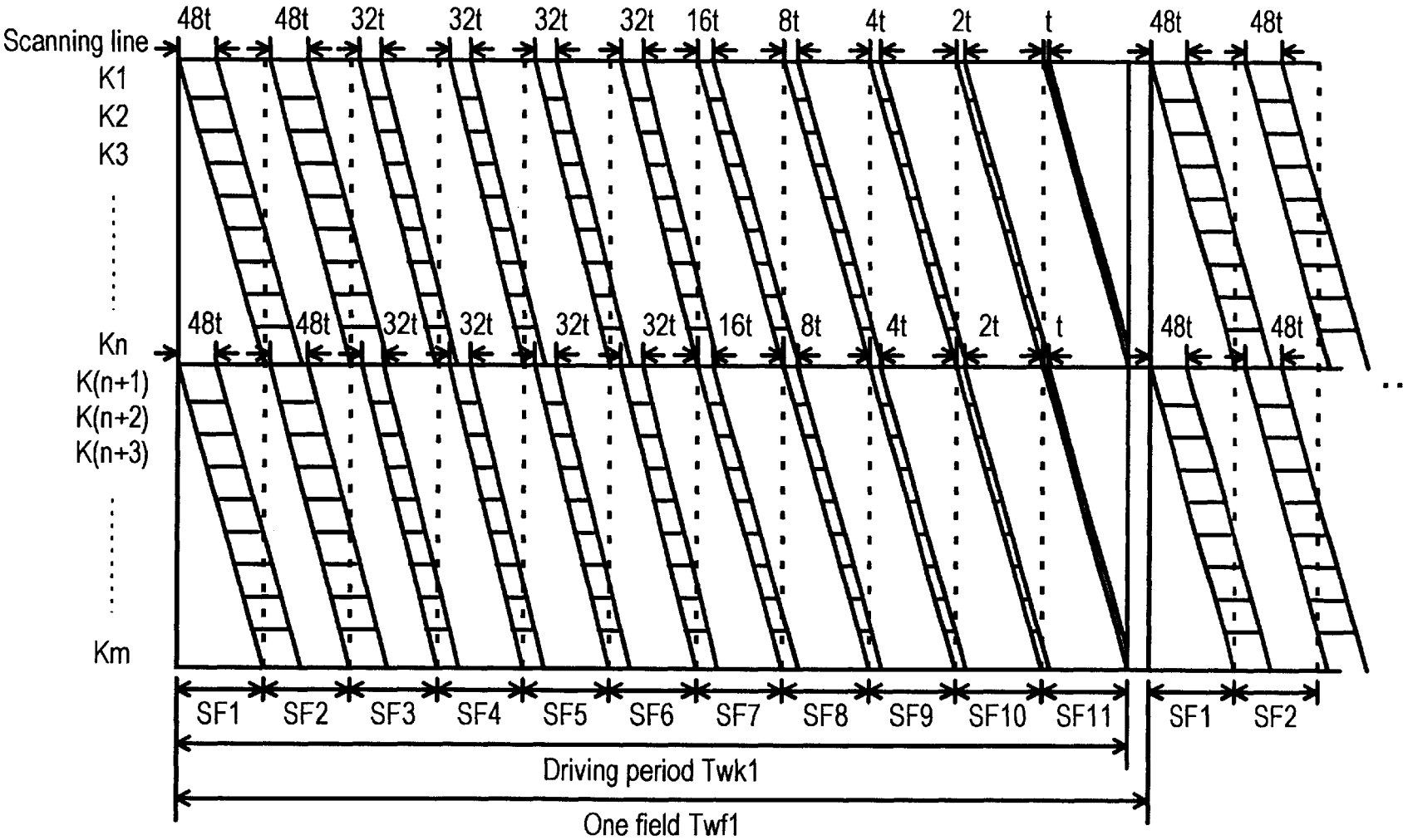
FIG. 8 is a configuration of a subfield in accordance with the fourth exemplary embodiment of the present invention.

The operation of the multi-scan adaptive video display monitor in the fourth exemplary embodiment as configured above is explained in details with reference to FIGS. 7 to 13. Referring to FIG. 8, the subfield number adjustment unit 11 instructs the subfield processor 4 and the selector 26 to drive the plasma display panel in eleven subfields SF1 to SF11 when the vertical synchronizing frequency is higher than a fourth specified level at which it may not be possible to drive up to the twelfth subfield within one-field period. Here, the selector 26 is controlled to select the output of the ROM table 22 which has an output bit width equivalent to the number of subfields.

Figure 9:
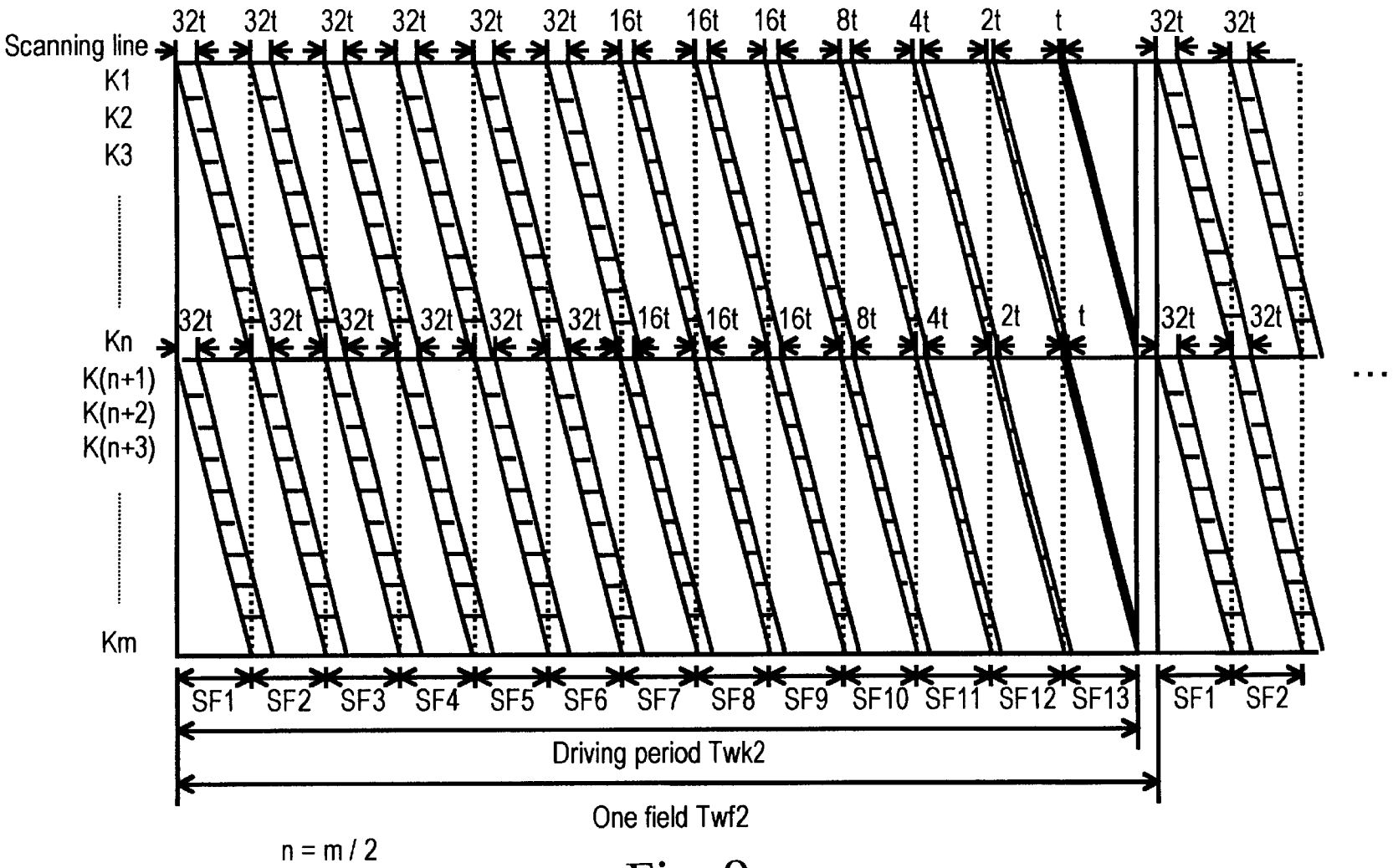
FIG. 9 is a configuration of a subfield in accordance with the fourth exemplary embodiment of the present invention.

On the other hand, according to FIG. 9, the subfield number adjustment unit 11 instructs the subfield processor 4 and the selector 26 to drive the plasma display panel in a total of thirteen subfields SF1 to SF13 when the vertical synchronizing frequency is lower than a fifth specified level at which it is possible to drive up to a thirteenth subfield within a one-field period. Here, the selector 26 selects the output of the ROM table 24 which has an output bit width equivalent to the number of subfields.

In the fourth exemplary embodiment as configured above, the subfield number adjustment unit 11 decreases the number of subfields when the vertical synchronizing frequency is higher than the fourth specified level, and the subfield number adjustment unit 11 increases the number of subfields when the vertical synchronizing frequency is lower than the fifth specified level. At the same time, the ROM table which corresponds to the number of subfields is also selected. As shown in FIG. 10, for example, the ROM tables 21 to 25 are set to be weighted in advance with a bit weight corresponding to each subfield. This allows the display of video images in the 256 grey-level regardless of the increase or decrease in the number of subfields.

FIG. 11 shows an example of allocation of the subfield to each grey level in the case of using twelve subfields. FIG. 11 shows allocation of subfields when 8-bit 256 grey-level input data is weighted to twelve subfields in accordance with a bit weighting table shown in FIG. 10. For example, when the subfields shown in FIG. 11 are allocated in accordance with the bit weighting table shown in FIG. 10, a pixel with a grey level 100 is displayed by illuminating four subfields: 5, 6, 7, and 10.

FIG. 12 is another example of the allocation of subfields to each grey level when eleven subfields are used. FIG. 12 shows allocation of subfields when 8-bit 256 grey-level input data is weighted to eleven subfields. For example, if the subfields shown in FIG. 12 are allocated in accordance with the bit weighting table shown in FIG. 10, a pixel of the grey level 100 is displayed by emitting four subfields: 4, 5, 6, and 9.

FIG. 13 is also another example of allocation of subfields to each grey level when thirteen subfields are used. FIG. 13 shows allocation of subfields when 8-bit 256 grey-level input data is weighted to thirteen subfields in accordance with the bit weighting table shown in FIG. 10. For example, if subfields shown in FIG. 13 are allocated in accordance with the bit weighting table shown in FIG. 10, a pixel of the grey level 100 is displayed by illuminating five subfields: 5, 6, 7, 8, and 11.

Weighting of subfields illustrated in FIG. 10, and allocation of subfields for each grey level illustrated in FIGS. 11, 12, and 13 are just examples, and there are other combinations.

This configuration assures the stable driving of a plasma display panel by preventing driving the first subfield in the next field while driving the subfield for a video image in a certain field where the video signal is not yet complete due to a high vertical synchronizing frequency. Display in the 256 grey-level can be maintained although the number of subfields decrease. It also enables the prevention of flicker by preventing clustering of driving of the plasma display panel in the first half of one field, which leaves some time after completing the driving of the twelfth subfield, caused by a longer one-field period. Display in the 256 grey-level can also be maintained although the number of subfields increases.

Fifth Exemplary Embodiment

Figure 14:
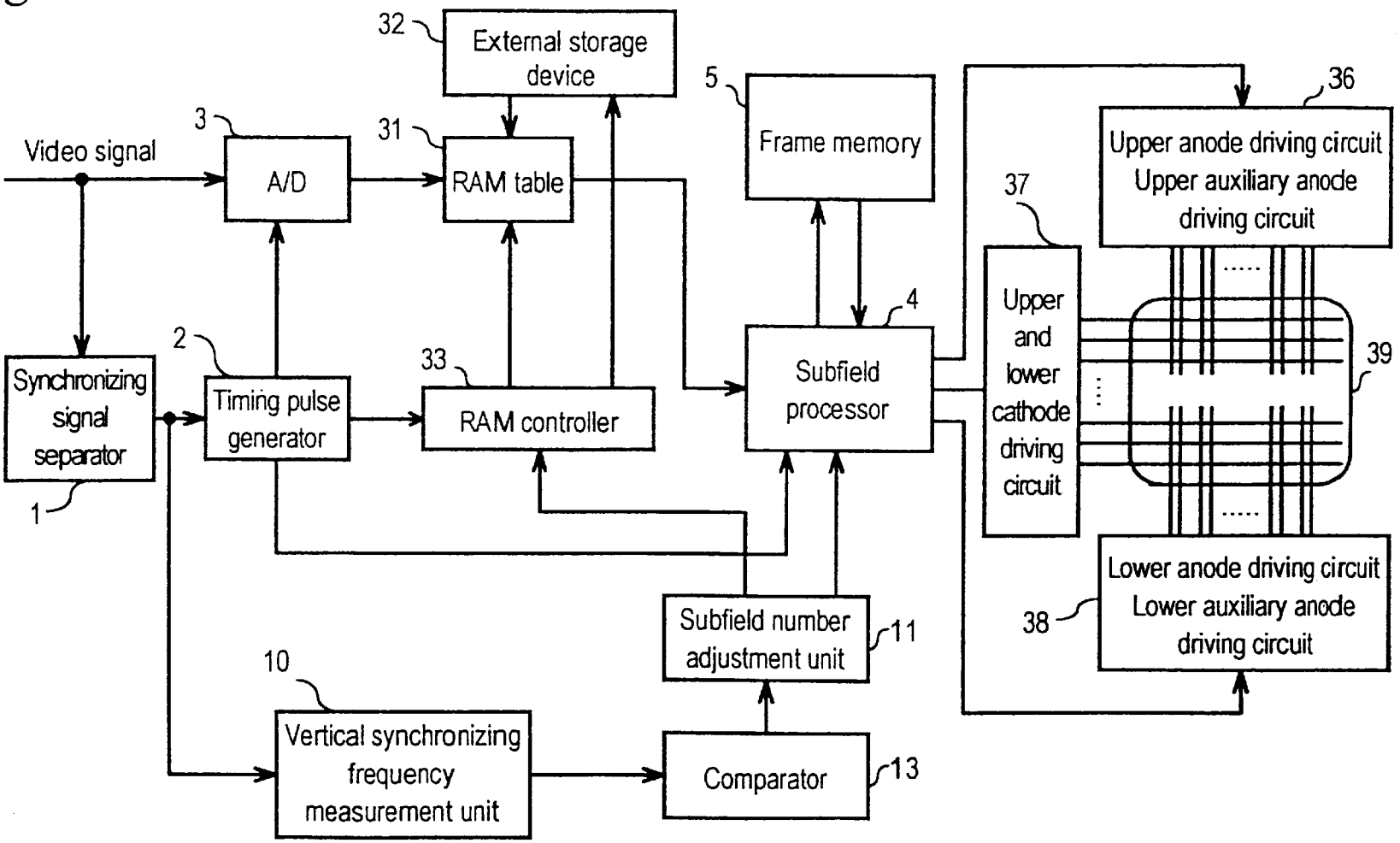
FIG. 14 is a configuration of a video display monitor in accordance with a fifth exemplary embodiment of the present invention.

FIG. 14 shows a configuration of a multi-scan adaptive video display monitor in a fifth exemplary embodiment. Components which have the same purpose and function as those in FIG. 7 which illustrates the fourth exemplary embodiment are given the same reference numerals, and thus their detailed explanation not repeated. In FIG. 14, reference numerals 1 to 5, 10, 11, 13, and 36 to 39 have the same purpose and configuration as those in FIG. 7 which illustrates the fourth exemplary embodiment, and thus their explanation is not repeated.

A RAM table 31 is for table conversion of the input video signal, an external storage device 32 stores data to be written to the RAM table 31, and a RAM controller 33 controls writing of table data stored in the external storage device 32 to the RAM table 31 in accordance with the output from the subfield number adjustment unit 11.

The operation of the multi-scan adaptive video display monitor in the fifth exemplary embodiment as configured above is explained in detail with reference to FIG. 14, and FIGS. 8 to 13. The subfield number adjustment unit 11 instructs the subfield processor 4 and the RAM controller 33 to drive the plasma display panel to eleven subfields in total, as shown in FIG. 8, when the vertical synchronizing frequency exceeds the fourth specified level at which it may not be possible to drive up to the twelfth subfield within a one-field period. Referring to FIG. 14, the RAM controller 33 selects the table data with an 11-bit output width, which is equivalent to the number of subfields, from the external storage device 32, and writes it to the RAM table 31.

The subfield number adjustment unit 11, on the other hand, instructs the subfield processor 4 and the RAM controller 33 to drive the plasma display panel in a total of thirteen subfields, as shown in FIG. 9, when the vertical synchronizing frequency is lower than the fifth specified level at which it may be possible to drive up to thirteen subfields within one-field period. Here, the RAM controller 33 selects the table data with a 13-bit output width, which is equivalent to the number of subfields, from the external storage device 32, and writes it to the RAM table 31.

In the fifth exemplary embodiment as configured above, the subfield number adjustment unit 11 decreases the number of subfields when the vertical synchronizing frequency is higher than the fourth specified level, and the subfield number adjustment unit 11 increases the number of subfields when the vertical synchronizing frequency is lower than the fifth specified level. In both cases, table data with the output bit width equivalent to the number of subfields can be written to the RAM table. Table data for each output bit width stored in the external storage device 32 are also preset to be weighted with a bit corresponding to each subfield in accordance with an example of weighting table as shown in FIG. 10, similar to that in the fourth exemplary embodiment. Allocation of subfields to each grey level for each number of subfields to be driven is also preset as shown in FIGS. 11, 12, and 13 for displaying the video signal in the 256 grey-level regardless of an increase or decrease in the number of subfields.

Similar to the fourth exemplary embodiment, the weighting of subfields illustrated in FIG. 10, and allocation of subfields for each grey level illustrated in FIGS. 11, 12, and 13 are just examples. There are other possible combinations.

With this configuration, the stable driving of the plasma display panel can be assured by preventing driving the first subfield in the next field while driving the subfield for a video image in a certain field where the video signal is not yet complete due to a high vertical synchronizing frequency. Flickering may also be prevented by avoiding clustering of driving of the plasma display panel in the first half of one field. This leaves some time after completing the driving of the twelfth subfield caused by a longer one-field period at a lower vertical synchronizing frequency. Display in the 256 grey-level can also be maintained regardless of the increase and decrease in the number of subfields.

The table data can be switched without degrading a video image displayed by writing table data to the RAM table during the vertical retrace period.

A wide range of devices including RAMs, ROMs, and data disks may be used as the external storage device 32. It is also possible to directly set data in the RAM table by creating data with a microcomputer.

As explained above, the present invention allows the subfield number adjustment unit to decrease the number of subfields when the vertical synchronizing frequency is higher than the first specified level, and increase the number of subfields when the vertical synchronizing frequency is lower than the second specified level. This may assure stable driving of the plasma display panel by preventing driving the first subfield in the next field while driving the subfield for a video image in a certain field where the video signal is not yet complete due to a high vertical synchronizing frequency. The present invention may also prevent flicker by preventing clustering of driving of the plasma display panel in the first half of one field, which leaves some time after completing the driving of the eighth subfield, caused by a longer one-field period when the vertical synchronizing frequency is low.

Consequently, the present invention provides a multi-scan adaptive video display monitor which assures stable driving of the plasma display panel by adjusting the number of subfields in response to the frequency of the vertical synchronizing signal in the input video signal.

The present invention also enables the subfield number adjustment unit to decrease the number of subfields when the vertical synchronizing frequency is higher than the first specified level, and extend the subfield length when the vertical synchronizing frequency is lower than the third specified level. This may assure stable driving of the plasma display panel by avoiding the driving of the first subfield in the next field while driving the subfield for a video image in a certain field where the video signal is not yet complete due to a high vertical synchronizing frequency. The present invention may also prevent flicker by preventing clustering of driving of the plasma display panel in the first half of one field, which leaves some time after completing the driving of the eighth subfield, caused by a longer one-field period when the vertical synchronizing frequency is low.

Consequently, the present invention provides a multi-scan adaptive video display monitor which assures stable driving of the plasma display panel by adjusting the number of subfields in response to the frequency of the vertical synchronizing signal in the input video signal.

The present invention further offers a multi-scan adaptive video display monitor which may prevent chattering when the frequency is switched by employing a comparator for comparing changes in the frequency using hysteresis and controlling the subfield number adjustment unit and subfield length adjustment unit, thereby assuring further stable driving of the plasma display panel.

The present invention further employs a subfield number adjustment unit for decreasing the number of subfields when the vertical synchronizing frequency is higher than the fourth specified level, and the output of the ROM table corresponding to the reduced number of subfields is selected. This may assure stable driving of the plasma display panel and maintain the display of a 256 grey-level signal by preventing driving the first subfield in the next field while driving the subfield for a video image in a certain field where the video signal is not yet complete. When the vertical synchronizing frequency is lower than the fifth specified level, the subfield number adjustment unit increases the number of subfields, and the output of the ROM table corresponding to increased number of subfields is selected. This may prevent flicker and maintain display in the 256 grey-level by preventing clustering of driving of the plasma display panel in the first half of one field, which leaves some time after completing the driving of the twelfth subfield, caused by a longer one-field period when the vertical synchronizing frequency is low.

The present invention further employs the subfield number adjustment unit for decreasing the number of subfields when the vertical synchronizing frequency is higher than the fourth specified level, and table data corresponding to reduced number of subfields is written to the RAM table.

This may assure stable driving of the plasma display panel and maintain display in the 256 grey-level by preventing driving the first subfield in the next field while driving the subfield for a video image in a certain field where the video signal is not yet complete. When the vertical synchronizing frequency is lower than the fifth specified level, the subfield number adjustment unit increases the number of subfields, and the table data corresponding to increased number of subfields is written to the RAM table. This may prevent flicker and maintain the display in the 256 grey-level by preventing clustering of driving of the plasma display panel in the first half of one field, which leaves some time after completing the driving of the twelfth subfield, caused by a longer one-field period when the vertical synchronizing frequency is low. Degradation of the video image due to table conversion may also be prevented by writing data to the RAM table during the vertical retrace period.

The present invention is explained relating to driving a DC plasma display. The same concept, with respect to division of a one-field field to multiple subfields, writing of data to the plasma display panel during each subfield, and sustaining of discharge in accordance with bit weighting for display in the 256 grey-level, is also applicable to AC plasma display monitors. The present invention is also applicable to both the single scanning and double scanning driving systems in AC plasma display monitors. The preferred embodiments described herein are therefore illustrative and not restrictive. The scope of the invention being indicated by the appended claims and all modifications which come within the true spirit of the claims are intended to be embraced therein.

What is claimed:

1. A video display monitor for use with a video signal having a vertical synchronizing frequency in which each field of the video signal is divided into a respective number of subfields, said subfields respectively weighted with one of a time width and a pulse value, and video images in said subfields are overlapped in a time base for displaying said video images as grey levels, said video display monitor comprising:

vertical synchronizing frequency measurement means for providing a measurement of the vertical synchronizing frequency of said video signal;

subfield number adjustment means for adjusting the number of said subfields in accordance with said measurement; and subfield length adjustment means for adjusting one of i) the time width of said subfields and ii) the pulse value of said subfields in accordance with the measuring result of said vertical synchronizing frequency measurement means.

2. The video display monitor according to claim 1, wherein said subfield number adjustment means comprises at least one of the following functions:

i) the number of said subfields is decreased when the vertical synchronizing frequency is higher than a first specified frequency, wherein said first specified frequency is a frequency at which driving up to a predetermined subfield number within one-field period is prevented in order to maintain a predetermined resolution;

ii) the number of said subfields is increased when the vertical synchronizing frequency is lower than a second specified frequency, wherein said second specified frequency is a frequency at which it is possible to drive up to a higher subfield number than said predetermined sub-field number within a one-field period; and iii) the number of said subfields is decreased when the vertical synchronizing frequency is higher than the first specified frequency, and the number of subfields is increased when the vertical synchronizing frequency is lower than the second specified frequency.

3. The video display monitor according to claim 2, further comprising comparison means for comparing the vertical synchronizing frequency and at least one of said first and second specified frequencies using hysteresis.

4. The video display monitor according to claim 1, further comprising a read only memory (ROM) table having different output bit widths corresponding to an input bit width, and one of the different output bit widths of said ROM table is selected in accordance with the number of said subfields determined by said subfield number adjustment means.

5. The video display monitor according to claim 4, wherein said subfield number adjustment means comprises at least one of the following functions:

i) the number of said subfields is decreased when the vertical synchronizing frequency is higher than a specified frequency, wherein at said specified frequency driving up to a predetermined subfield number within a one-field period is prevented in order to maintain a predetermined resolution;

ii) the number of said subfields is increased when the vertical synchronizing frequency is lower than another specified frequency, wherein at said another specified frequency a higher subfield number than said predetermined subfield number is driveable up to within a one-field period; and iii) the number of said subfields is decreased when the vertical synchronizing frequency is higher than said specified frequency, and the number of subfields is increased when the vertical synchronizing frequency is lower than said another specified frequency.

6. The video display monitor according to claim 5, further comprising comparison means for comparing the vertical synchronizing frequency and at least one of said specified frequency and another specified frequency using hysteresis.

7. The video display monitor according to claim 4, further comprising subfield length adjustment means for adjusting one of i) the time width of said subfields and ii) the pulse value of said subfields.

8. The video display monitor according to claim 7, wherein said subfield number adjustment means decreases the number of said subfields when said vertical synchronizing frequency is higher than a specified frequency, and said subfield length adjustment means extends a length of said subfields when said vertical synchronizing frequency is lower than another specified frequency.

9. The video display monitor according to claim 8, further comprising comparison means for comparing the vertical synchronizing frequency and at least one of said specified frequency and another specified frequency using hysteresis.

10. The video display monitor according to claim 1, further comprising:

a random access memory (RAM) table for conducting a conversion of the video signal; and RAM control means for writing table data having an output bit width equivalent to the number of subfields determined by said subfield number adjustment means to said RAM table.

11. The video display monitor according to claim 10, wherein said RAM control means writes the table data to said RAM table during a vertical retrace period of said video signal.

12. The video display monitor according to claim 11, wherein said subfield number adjustment means comprises at least one of the following functions:

i) the number of said subfields is decreased when the vertical synchronizing frequency is higher than a specified frequency, wherein at said specified frequency driving up to a predetermined subfield number within a one-field period is prevented in order to maintain a predetermined resolution;

ii) the number of said subfields is increased when the vertical synchronizing frequency is lower than a further specified frequency, wherein at said further specified frequency a higher subfield number than said predetermined subfield number is driveable to within a one-field period; and iii) the number of said subfields is decreased when the vertical synchronizing frequency is higher than said specified frequency, and the number of subfields is increased when the vertical synchronizing frequency is lower than said further specified frequency.

13. The video display monitor according to claim 10, wherein said subfield number adjustment means comprises at least one of the following functions:

i) the number of said subfields is decreased when the vertical synchronizing frequency is higher than a specified frequency, wherein at said specified frequency driving up to a predetermined subfield number within a one-field period is prevented in order to maintain a predetermined resolution;

ii) the number of said subfields is increased when the vertical synchronizing frequency is lower than another specified frequency wherein at said another specified frequency a higher subfield number than said predetermined subfield number is driveable to within a one-field period; and iii) the number of said subfields is decreased when the vertical synchronizing frequency is higher than said specified frequency, and the number of subfields is increased when the vertical synchronizing frequency is lower than said another specified frequency.

14. The video display monitor according to claim 10, further comprising subfield length adjustment means for adjusting one of i) the time width of said subfields and ii) the pulse value of said subfields.

15. A video display monitor for use with a video signal having a vertical synchronizing frequency in which each field of the video signal is divided into a respective number of subfields, said subfields respectively weighted with one of a time width and a pulse value, and video images in said subfields are overlapped in a time base for displaying said video images as grey levels, said video display monitor comprising:

vertical synchronizing frequency measurement means for providing a measurement of the vertical synchronizing frequency of said video signal;

subfield number adjustment means for adjusting the number of said subfields in accordance with said measurement and for decreasing the number of said subfields when said vertical synchronizing frequency is higher than a specified frequency wherein said specified frequency is a frequency at which driving up to a predetermined subfield number within a one-field period is prevented in order to maintain a predetermined resolution;

subfield length adjustment means for extending a length of said subfields when said vertical synchronizing frequency is lower than another specified frequency, wherein said another specified frequency is a frequency at which a longer subfield length than a predetermined subfield length is settable within a one-field period.

16. The video display monitor according to claim 15, further comprising comparison means for comparing the vertical synchronizing frequency and at least one of said specified frequency and said another specified frequency using hysteresis.

* * * * *